US006472364B1

(12) United States Patent
Heltovics

(10) Patent No.: US 6,472,364 B1
(45) Date of Patent: Oct. 29, 2002

(54) DETERGENT COMPOSITIONS OR COMPONENTS

(75) Inventor: Gabor Heltovics, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/807,388

(22) PCT Filed: Oct. 6, 1999

(86) PCT No.: PCT/US99/23147

§ 371 (c)(1),
(2), (4) Date: Apr. 12, 2001

(87) PCT Pub. No.: WO00/22079

PCT Pub. Date: Apr. 20, 2000

Related U.S. Application Data

(60) Provisional application No. 60/103,978, filed on Oct. 13, 1998, and provisional application No. 60/148,053, filed on Aug. 10, 1999.

(30) Foreign Application Priority Data

Mar. 11, 1999 (GB) ..... 9905474

(51) Int. Cl.[7] ..... C11D 1/83; C11D 1/94; C11D 3/26; C11D 3/30

(52) U.S. Cl. ..... 510/500; 510/350; 510/351; 510/499; 510/501; 510/473; 544/242; 544/402; 548/300.1; 548/335.5

(58) Field of Search ..... 510/327, 328, 510/340, 332, 350, 351, 352, 356, 360, 499, 500, 501, 473; 544/242, 402; 548/335.5, 300.1

(56) References Cited

U.S. PATENT DOCUMENTS

| | | | | |
|---|---|---|---|---|
| 3,917,817 A | | 11/1975 | Vanlerberghe et al. | |
| 4,013,787 A | * | 3/1977 | Varlerberghe et al. | 424/70 |
| 6,251,846 B1 | * | 6/2001 | Panandiker et al. | 510/332 |

FOREIGN PATENT DOCUMENTS

| | | | |
|---|---|---|---|
| DE | 19643281 | * | 4/1998 |
| WO | WO 99/14301 | * | 3/1999 |

* cited by examiner

*Primary Examiner*—Gregory Delcotto
(74) *Attorney, Agent, or Firm*—Julia A. Glazer; Kim William Zerby; Steven W. Miller

(57) ABSTRACT

The present invention relates to detergent compositions or components comprising certain cyclic amine based polymers and certain anionic cellulose materials. This combination imparts improved appearance and integrity benefits to fabrics and textiles laundered in washing solutions formed from such compositions, while also providing improved whiteness and/or brightness maintenance.

10 Claims, No Drawings

DETERGENT COMPOSITIONS OR COMPONENTS

This application claims benefit of U.S. Provisional Application No. 60/103,978, filed Oct. 13, 1998, and U.S. Provisional Application No. 60/148,053, filed Aug. 10, 1999.

TECHNICAL FIELD

The present invention relates to compositions or components comprising certain cyclic amine based polymers and certain anionic cellulose materials.

BACKGROUND OF THE INVENTION

It is known that fabrics and textiles simply wear out over time and with use. Also, the laundering of the fabrics and textiles, over many cycles, can accentuate and contribute to the deterioration of the integrity and the appearance of such fabrics and textiles. Deterioration of fabric integrity and appearance can manifest itself in several ways. For example, short fibers are dislodged from woven and knit fabric/textile structures by the mechanical action of laundering. These dislodged fibers may form lint, fuzz or "pills" which are visible on the surface of fabrics and diminish the appearance of newness of the fabric. Further, repeated laundering of fabrics and textiles, especially with bleach-containing laundry products, can remove dye from fabrics and textiles and impart a faded, worn out appearance as a result of diminished color intensity, and in many cases, as a result of changes in hues or shades of color.

Given the foregoing, there is clearly an ongoing need to identify materials which could be added to laundry detergent products that would associate themselves with the fibers of the fabrics and textiles laundered using such detergent products and thereby reduce or minimize the tendency of the laundered fabric/textiles to deteriorate in appearance. Any such detergent product additive material should, of course, be able to benefit fabric appearance and integrity without unduly interfering with the ability of the laundry detergent to perform its fabric cleaning function. Co-pending applications PCT/US98/19143 describes the use of certain cyclic amine based polymers which are found to provide excellent integrity benefits to fabrics.

The inventor has now found that when these amine based polymers are used in combination with specific anionic cellulose material, the fabric care and fabric integrity can be further improved. It is believed that these benefits are achieved because the anionic cellulose material and the amine based polymers having a positively charged group, interact together in such a manner that both polymeric materials have an improved surface activity, resulting in a better interaction with or deposition onto the surface of the fabric. It is believed that when the polymeric materials are present in an intimate mixture, such an interaction between the polymeric materials is even more likely to occur or even stronger, resulting in a greater benefit obtained when the polymeric materials are present in the product as an intimate mixture or in the same component or granule.

Not only an improved fabric integrity is achieved, but also an improved soil removal and whiteness or brightness maintenance is achieved when these compounds are used together. The inventor also found that when the anionic cellulose material and the amine based polymer are present in an intimate mixture, such as in the form of an agglomerate, a compacted granule or a spray dried granule, these benefits are even more apparent.

SUMMARY OF THE INVENTION

The present invention relates to a detergent composition or component or additive comprising:

a) from 0.01% to 90% by weight, preferably from 0.05% to 50% by weight, of a salt of an anionic cellulose material comprising an anionic substituent group R—X—Z wherein R is a saturated, unsaturated or aromatic hydrocarbon spacer group. X is oxygen, nitrogen or sulphur. Z is carboxylate, sulphonate, sulphate or phosphonate group; and b) from 0.01% to 90% by weight, preferably from about 0.05% to about 20% by weight of a cyclic amine based polymer.

The present invention also relates to the laundering or treating of fabrics and textiles in aqueous washing or treating solutions formed from effective amounts of the detergent compositions or components described herein, or formed from the individual polymeric materials of such compositions or components. Laundering of fabrics and textiles in such washing solutions imparts fabric appearance benefits to the fabric and textile articles so treated. Such benefits can include improved overall appearance, pill/fuzz reduction, antifading, improved abrasion resistance, and/or enhanced softness and also improved whiteness and/or brightness maintenance or even improved cleaning performance.

The cyclic amine based polymers and the cellulose material are preferably in an intimate mixture with one another. In one preferred embodiment, the compounds are intimately mixed prior to introduction to the composition or component of the invention.

Preferably, the mixture is present in an agglomerated, compacted or spray-dried particle, when the composition or component is solid.

Hereby it may be preferred that the compounds are mixed with an anionic surfactant, preferably LAS, as described herein after. It may also be preferred that a hydrotrope is admixed to this mixture, preferably STS. Also preferably present in the mixture are inorganic and/or organic salts and acids and/or silicates or aluminosilicates, including zeolite, amorphous silicates, crystalline layered silicates, carbonate, bicarbonate, phosphate, citric acid, malic acid, maleic acid, tartaric acid or salts thereof, or mixtures of these ingredients.

DETAILED DESCRIPTION OF THE INVENTION

Cyclic Amine Based Polymer Materials

An essential component, the compositions or components of the present invention comprise one or more cyclic amine based polymer.

When used herein, 'polymers' include not only polymers, but also oligomers, co-polymers, co-oligomers, present in any structural arrangement, also including cross-linked arrangements. As will be apparent to those skilled in the art, an oligomer is a molecule consisting of only a few monomer units while polymers comprise considerably more monomer units. For the present invention, oligomers are defined as molecules having an average molecular weight below about 1,000 and polymers are molecules having an average molecular weight of greater than about 1,000 copolymers or co-oligomers are materials wherein two or more dissimilar monomers have been simultaneously or sequentially polymerized. Copolymers or co-oligomers of the present invention can include, for example, polymers or oligomers polymerized from a mixture of a primary cyclic amine based monomer, e.g., piperadine, and a secondary cyclic amine monomer, e.g., morpholine.

Depending on the application of the composition or component herein, the amount of cyclic amine based polymer may very. The cyclic amine based polymers herein will generally be about 0.01% to about 90% by the weight of the detergent composition or component, more preferably from 0.05% to 20% or even from 0.05% to 15% by weight. In detergent compositions herein it may for example be preferred that the polymer is present at a level of from 0.05% to 10% by weight of the detergent composition, preferably from 0.05% to 5% or even from 0.05% to 3% or even 0.1% to 2% by weight. In detergent components or additives, the polymer may preferably be present at a level of 0.05% to 40% by weight or even from 0.05% to 20% or even 0.1% to 15% or even 1% to 10% by weight.

The cyclic amine based polymer herein is preferably present in the composition or component in such an amount that the concentration of cyclic amine in the wash is from 100 ppm to 10,000 ppm, preferably from 500 ppm to 7000 ppm or even from 1000 to about 3000 ppm.

The preferred cyclic amine based polymers herein can be characterized by the following general formula:

wherein:

each T is independently selected from the group consisting of H, $C_1$–$C_{12}$ alkyl, substituted alkyl, $C_7$–$C_{12}$ alkylaryl, —$(CH_2)_hCOOM$, —$(CH_2)_hSO_3M$, $CH_2CH(OH)SO_3M$, —$(CH_2)_hOSO_3M$

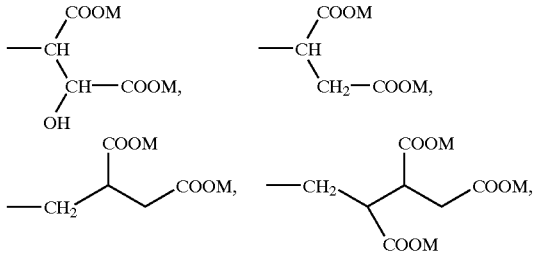

and —$R_2Q$;

wherein W comprises at least one cyclic constituent selected from the group consisting of:

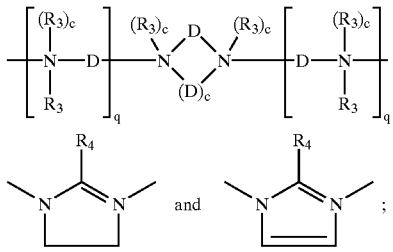

in addition to the at least one cyclic constituent, W may also comprise an aliphatic or substituted aliphatic moiety of the general structure;

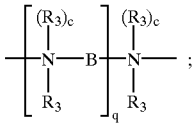

each B is independently $C_1$–$C_{12}$ alkylene, $C_1$–$C_{12}$ substituted alkylene, $C_3$–$C_{12}$ alkenylene, $C_8$–$C_{12}$ dialkylarylene, $C_8$–$C_{12}$ dialkylarylenediyl, and —$(R_5O)_nR_5$—;

each D is independently $C_2$–$C_6$ alkylene;

each Q is independently selected from the group consisting of hydroxy, $C_1$–$C_{18}$ alkoxy, $C_2$–$C_{18}$ hydroxyalkoxy, amino, $C_1$–$C_{18}$ alkylamino, dialkylamino, trialkylamino groups, heterocyclic monoamino groups and diamino groups;

each $R_1$ is independently selected from the group consisting of H, $C_1$–$C_8$ alkyl and $C_1$–$C_8$ hydroxyalkyl;

each $R_2$ is independently selected from the group consisting of $C_1$–$C_{12}$ alkylene, $C_1$–$C_{12}$ alkenylene, —$CH_2$—$CH(OR_1)$—$CH_2$, $C_8$–$C_{12}$ alkarylene, $C_4$–$C_{12}$ dihydroxyalkylene, poly($C_2$–$C_4$ alkyleneoxy)alkylene, $H_2CH(OH)CH_2OR_2OCH_2CH(OH)CH_2$—, and $C_3$–$C_{12}$ hydrocarbyl moieties;

provided that when $R_2$ is a $C_3$–$C_{12}$ hydrocarbyl moiety the hydrocarbyl moiety can comprise from about 2 to about 4 branching moieties of the general structure:

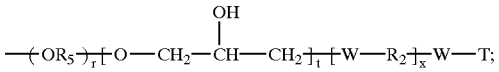

each $R_3$ is independently selected from the group consisting of H, O, $R_2$, $C_1$–$C_{20}$ hydroxyalkyl, $C_1$–$C_{20}$ alkyl, substituted alkyl, $C_6$–$C_{11}$ aryl, substituted aryl, $C_7$–$C_{11}$ alkylaryl, $C_1$–$C_{20}$ aminoalkyl, —$(CH_2)_hCOOM$, —$(CH_2)_hSO_3M$, $CH_2CH(OH)SO_3M$, —$(CH_2)_hOSO_3M$,

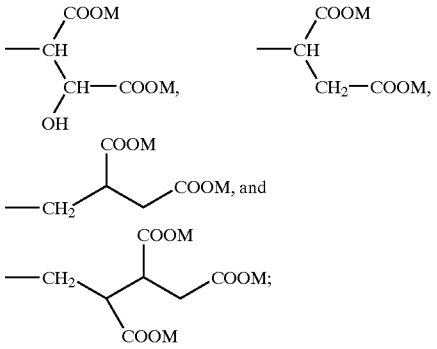

each $R_4$ is independently selected from the group consisting of H, $C_1$–$C_{22}$ alkyl, $C_1$–$C_{22}$ hydroxyalkyl, aryl and $C_7$–$C_{22}$ alkylaryl;

each $R_5$ is independently selected from the group consisting of $C_2$–$C_8$ alkylene, $C_2$–$C_8$ alkyl substituted alkylene; and A is a compatible monovalent or di or polyvalent anion;

M is a compatible cation;

b=number necessary to balance the charge;

each x is independently from 3 to about 1000;

each c is independently 0 or 1;

each h is independently from about 1 to about 8;

each q is independently from 0 to about 6;

each n is independently from 1 to about 20;

each r is independently from 0 to about 20: and each t is independently from 0 to 1.

The cyclic amine based polymer may comprise combinations of these cyclic amine based materials. For example, a mixture of piperadine and epihalohydrin condensates can be combined with a mixture of morpholine and epihalohydrin condensates to achieve the desired fabric treatment results. Moreover, the molecular weight of cyclic polymers can vary within the mixture as is illustrated herein.

Preferred compounds that fall within this general structure include compounds:

wherein each $R_1$ is H; and at least one W is selected from the group consisting of:

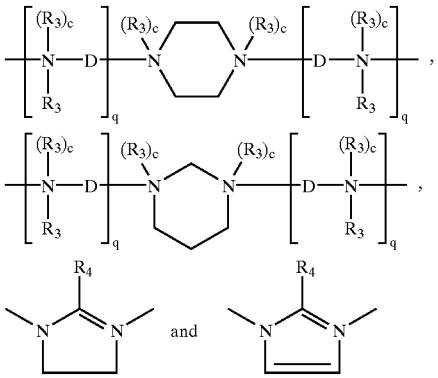

Even more preferred compounds are those:

wherein each $R_1$ is H; and at least one W is selected from the group consisting of:

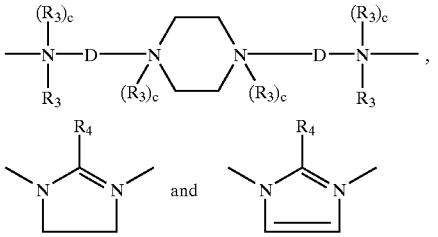

And most preferred compounds are those:

wherein each $R_1$ is H; and at least one W is selected from the group consisting of:

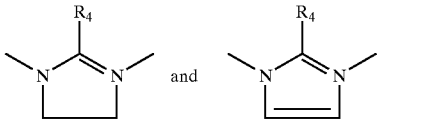

Preferred compounds to be used as the linking group $R_2$ include, but are not limited to: polyepoxides, ethylenecarbonate, propylenecarbonate, urea, α, β-unsaturated carboxylic acids, esters of α, β-unsaturated carboxylic acids, amides of α, β-unsaturated carboxylic acids, anhydrides of α, β-unsaturated carboxylic acids, di- or polycarboxylic acids, esters of di- or polycarboxylic acids, amides of di- or polycarboxylic acids, anhydrides of di- or polycarboxylic acids, glycidylhalogens, chloroformic esters, chloroacetic esters, derivatives of chloroformic esters, derivatives of chloroacetic esters, epihalohydrins, glycerol dichlorohydrins, bis-(halohydrins), polyetherdihalo-compounds, phosgene, polyhalogens, functionalized glycidyl ethers and mixtures thereof. Moreover, $R_2$ can also comprise a reaction product formed by reacting one or more of polyetherdiamines, alkylenediamines, polyalkylenepolyamines, alcohols, alkyleneglycols and polyalkyleneglycols with α, β-unsaturated carboxylic acids, esters of α, β-unsaturated carboxylic acids, amides of α, β-unsaturated carboxylic acids and anhydrides of α, β-unsaturated carboxylic acids provided that the reaction products contain at least two double bonds, two carboxylic groups, two amide groups or two ester groups.

Also preferred cyclic amine based polymers for use herein include adducts of two or more compositions selected from the group consisting of piperazine, piperadine, epichlorohydrin, epichlorohydrin benzyl quat, epichlorohydrin methyl quat, morpholine and mixtures thereof.

Highly preferred cyclic amine based polymers herein are referred to as Imidazole-epi chlorohydrin copolymers.

These cyclic amine based polymers can be linear or branched. One specific type of branching can be introduced using a polyfunctional crosslinking agent. An example of such such polymer is exemplified below.

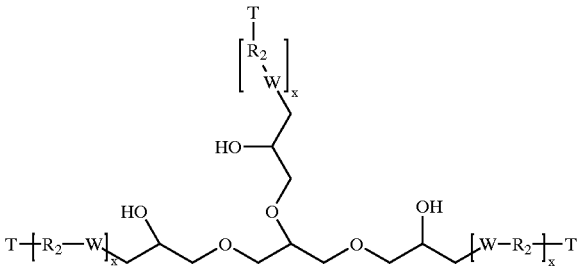

Anionic Cellulose Material

The compositions or components herein comprise a salt of an anionic cellulose material comprising an anionic substituent group R—X—Z wherein R is a saturated, unsaturated or aromatic hydrocarbon spacer group, X is oxygen, nitrogen or sulphur, Z is carboxylate, sulphonate, sulphate or phosphonate group.

The hydrocarbon spacer group is preferably a $C_1$–$C_{18}$, more preferably a $C_1$–$C_{14}$, or even more preferably a $C_1$–$C_4$ saturated, unsaturated or aromatic group, preferably an alkylene group. The spacer group may also be substituted with one or more hydroxy groups.

The group X is preferably a nitrogen, or even more preferably an oxygen atom.

The group Z is preferably a carboxylate group.

Highly preferred hereon are the so-called salts of carboxyalkyl celluloses, whereby preferably the alkylene group (or the so-called alkyl group) comprises from 1 to 4 carbon atoms. Most preferred herein is a salt of carboxymethyl cellulose.

The cation of the salt is preferably a potassium ion or more preferably a sodium ion.

Depending on the application of the composition or component herein, the amount of cellulose material may very. The anionic cellulose material herein will generally be about 0.01% to about 90% by the weight of the detergent composition or component, more preferably from 0.05% to 50% or even from 0.05% to 20%. In detergent compositions herein it may for example be preferred that the material is present at a level of from 0.05% to 10% by weight of the detergent composition, preferably from 0.05% to 7% or even from 0.05% to 5% or even 0.5% to 3%. In components herein, such as detergent additives, the material may preferably be present at a level of 0.05% to 40% by weight of the component, or even from 0.05% to 20% or even 0.1% to 15% or even 1% to 10%.

The anionic cellulose material herein is preferably present in the composition or component in such an amount that the concentration of cyclic amine in the wash is from 100 ppm to 10,000 ppm, preferably from 500 ppm to 7000 ppm or even from 1000 to about 3000 ppm.

Detergent Compositions or Components

The compositions or components of the invention are preferably laundry, compositions, preferably in the form of granules, extrudates, flakes or tablets, liquids or pastes.

The compositions or components in accord with the invention may also contain additional detergent components. The precise nature of these additional components, and levels of incorporation thereof will depend on the physical form of the composition or component, and the precise nature of the washing operation for which it is to be used.

They preferably contain one or more additional detergent components selected from surfactants, bleaches, bleach catalysts, alkalinity systems, builders, phosphate-containing builders, additional organic polymeric compounds, including dispersants, soil suspension and anti-redeposition agents soil releasing agents, enzymes, suds suppressors, lime soap, perfumes, brightners, photobleaching agents and additional corrosion inhibitors.

Preferred additional ingredients are hydrophobically modified ether and ester cellulosic polymers as described in co-pending application PCT/US98/19139 and PCT/US98/19142. These polymers may be present at a level of from 0.01% to 10% by weight of the composition, more preferably at a level of from 0.05% to 5% by weight or even form 0.1% to 2% by weight of the composition, or at a level of from 0.05% to 30% by weight of the component, more preferably at a level of from 0.1% to 20% by weight or even form 0.3% to 10% by weight of the component.

Also highly preferred are enzymes, cationic softening agents, clay, optionally together with polymeric flocculants, dye transfer inhibitors, or preferably mixtures thereof, as described herein after.

Surfactant

The components or compositions in accord with the invention preferably contain one or more surfactants selected from anionic, nonionic, cationic, ampholytic, amphoteric and zwitterionic surfactants and mixtures thereof.

A typical listing of anionic, nonionic, ampholytic, and zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). A list of suitable cationic surfactants is given in U.S. Pat. No. 4,259,217 issued to Murphy on Mar. 31, 1981.

Where present, ampholytic, amphoteric and zwitteronic surfactants are generally used in combination with one or more anionic and/or nonionic surfactants.

Anionic Surfactant

The components or compositions in accord with the present invention preferably comprise an additional anionic surfactant. Essentially any anionic surfactants useful for detersive purposes can be comprised in the detergent components or compositions. These can include salts (including, for example, sodium, potassium, ammonium, and substituted ammonium salts such as mono-, di- and triethanolamine salts) of the anionic sulfate, sulfonate, carboxylate and sarcosinate surfactants. Anionic sulfate and sulfonate surfactants are preferred.

Highly preferred are surfactants systems comprising a sulfonate and a sulfate surfactant, preferably a linear or branched alkyl benzene sulfonate and alkyl ethoxylsulfates, as described herein, preferably combined with a cationic surfactants as described herein.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic Sulfate Surfactant

Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$–$C_{17}$ acyl-N—($C_1$–$C_4$ alkyl) and —N—($C_1$–$C_2$ hydroxyalkyl) glucamine sulfates, and sulfates of alkylpolysaccharides such as the sulfates of alkylpolyglucoside (the nonionic nonsulfated compounds being described herein).

Alkyl sulfate surfactants are preferably selected from the linear and branched primary $C_{10}$–$C_{18}$ alkyl sulfates, more preferably the $C_{11}$–$C_{15}$ branched chain alkyl sulfates and the $C_{12}$–$C_{14}$ linear chain alkyl sulfates.

Alkyl ethoxysulfate surfactants are preferably selected from the group consisting of the $C_{10}$–$C_{18}$ alkyl sulfates which have been ethoxylated with from 0.5 to 20 moles of ethylene oxide per molecule. More preferably, the alkyl ethoxysulfate surfactant is a $C_{11}$–$C_{18}$, most preferably $C_{11}$–$C_{15}$ alkyl sulfate which has been ethoxylated with from 0.5 to 7, preferably from 1 to 5, moles of ethylene oxide per molecule.

A particularly preferred aspect of the invention employs mixtures of the preferred alkyl sulfate and/or sulfonate and alkyl ethoxysulfate surfactants. Such mixtures have been disclosed in PCT Patent Application No. WO 93/18124.

Anionic Sulfonate Surfactant

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Anionic Carboxylate Surfactant

Suitable anionic carboxylate surfactants include the alkyl ethoxy carboxylates, the alkyl polyethoxy polycarboxylate surfactants and the soaps ('alkyl carboxyls'), especially certain secondary soaps as described herein.

Suitable alkyl ethoxy carboxylates include those with the formula $RO(CH_2CH_2O)_xCH_2C00^-M^+$ wherein R is a $C_6$ to $C_{18}$ alkyl group, x ranges from 0 to 10, and the ethoxylate distribution is such that, on a weight basis, the amount of material where x is 0 is less than 20% and M is a cation. Suitable alkyl polyethoxy polycarboxylate surfactants include those having the formula RO—($CHR_1$—$CHR_2$—O)—$R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, and $R_3$ is selected from the group consisting of hydrogen, substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid.

Certain soaps may also be included as suds suppressers.

Alkali Metal Sarcosinate Surfactant

Other suitable anionic surfactants are the alkali metal sarcosinates of formula $R—CON(R^1)CH_2COOM$, wherein R is a $C_5$–$C_{17}$ linear or branched alkyl or alkenyl group, $R^1$ is a $C_1$–$C_4$ alkyl group and M is an alkali metal ion. Preferred examples are the myristyl and oleoyl methyl sarcosinates in the form of their sodium salts.

Alkoxylated Nonionic Surfactant

Essentially any alkoxylated nonionic surfactants are suitable herein. The ethoxylated and propoxylated nonionic surfactants are preferred.

Preferred alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

Nonionic Alkoxylated Alcohol Surfactant

The condensation products of aliphatic alcohols with from 1 to 25 moles of alkylene oxide, particularly ethylene oxide and/or propylene oxide, are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol.

Nonionic Polyhydroxy Fatty Acid Amide Surfactant

Polyhydroxy fatty acid amides suitable for use herein are those having the structural formula $R^2CONR^1Z$ wherein: R1 is H, $C_1$–$C_4$ hydrocarbyl, 2-hydroxy ethyl, 2-hydroxy propyl, ethoxy, propoxy, or a mixture thereof, preferable C1–C4 alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

Nonionic Fatty Acid Amide Surfactant

Suitable fatty acid amide surfactants include those having the formula: $R^6CON(R^7)_2$ wherein $R^6$ is an alkyl group containing from 7 to 21, preferably from 9 to 17 carbon atoms and each $R^7$ is selected from the group consisting of hydrogen, $C_1$–$C_4$ alkyl, $C_1$–$C_4$ hydroxyalkyl, and $—(C_2H_4O)_xH$, where x is in the range of from 1 to 3.

Nonionic Alkylpolysaccharide Surfactant

Suitable alkylpolysaccharides for use herein are disclosed in U.S. Pat. No. 4,565,647, Llenado, issued Jan. 21, 1986, having a hydrophobic group containing from 6 to 30 carbon atoms and a polysaccharide, e.g., a polyglycoside, hydrophilic group containing from 1.3 to 10 saccharide units.

Preferred alkylpolyglycosides have the formula:

$$R^2O(C_nH_{2n}O)t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl is preferably derived from glucose.

Amphoteric Surfactant

Suitable amphoteric surfactants for use herein include the amine oxide surfactants and the alkyl amphocarboxylic acids.

Suitable amine oxides include those compounds having the formula $R^3(OR^4)_xN^0(R^5)_2$ wherein $R^3$ is selected from an alkyl, hydroxyalkyl, acylamidopropoyl and alkyl phenyl group, or mixtures thereof, containing from 8 to 26 carbon atoms; $R^4$ is an alkylene or hydroxyalkylene group containing from 2 to 3 carbon atoms, or mixtures thereof; x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$–$C_{18}$ alkyl dimethylamine oxide, and $C_{10-18}$ acylamido alkyl dimethylamine oxide.

A suitable example of an alkyl aphodicarboxylic acid is Miranol(TM) C2M Conc. manufactured by Miranol, Inc., Dayton. N.J.

Zwitterionic Surfactant

Zwitterionic surfactants can also be incorporated into the detergent components or compositionss in accord with the invention. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Suitable betaines are those compounds having the formula $R(R')_2N^+R^2COO—$ wherein R is a $C_6$–$C_{18}$ hydrocarbyl group, each $R^1$ is typically $C_1$–$C_3$ alkyl, and $R^2$ is a $C_1$–$C_5$ hydrocarbyl group. Preferred betaines are $C_{12-18}$ dimethylammonio hexanoate and the $C_{10-18}$ acylamidopropane (or ethane) dimethyl (or diethyl) betaines. Complex betaine surfactants are also suitable for use herein.

Cationic Surfactants

Suitable cationic surfactants to be used in the detergent herein include the quaternary ammonium surfactants. Preferably the quaternary ammonium surfactant is a mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups. Preferred are also the mono-alkoxylated and bis-alkoxylated amine surfactants.

Another suitable group of cationic surfactants which can be used in the detergent compositions or components thereof herein are cationic ester surfactants. The cationic ester surfactant is a, preferably water dispersible, compound having surfactant properties comprising at least one ester (i.e. —COO—) linkage and at least one cationically charged group.

Suitable cationic ester surfactants, including choline ester surfactants, have for example been disclosed in U.S. Pat. Nos 4,228,042, 4,239,660 and 4,260,529.

In one preferred aspect the ester linkage and cationically charged group are separated from each other in the surfactant molecule by a spacer group consisting of a chain comprising at least three atoms (i.e. of three atoms chain length), preferably from three to eight atoms, more preferably from three to five atoms, most preferably three atoms. The atoms forming the spacer group chain are selected from the group consisting of carbon, nitrogen and oxygen atoms and any mixtures thereof, with the proviso that any nitrogen or oxygen atom in said chain connects only with carbon atoms in the chain. Thus spacer groups having, for example, —O—O— (i.e. peroxide), —N—N—, and —N—O— linkages are excluded, whilst spacer groups having, for example —$CH_2$—O—$CH_2$— and —$CH_2$—NH—$CH_2$— linkages are included. In a preferred aspect the spacer group chain comprises only carbon atoms, most preferably the chain is a hydrocarbyl chain.

Cationic Mono-alkoxylated Amine Surfactants

Highly preferred herein are cationic mono-alkoxylated amine surfactant preferably of the general formula I:

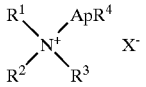

(I)

wherein $R^1$ is an alkyl or alkenyl moiety containing from about 6 to about 18 carbon atoms, preferably 6 to about 16 carbon atoms, most preferably from about 6 to about 14 carbon atoms; $R^2$ and $R^3$ are each independently alkyl groups containing from one to about three carbon atoms, preferably methyl, most preferably both $R^2$ and $R^3$ are methyl groups; $R^4$ is selected from hydrogen (preferred), methyl and ethyl; $X^-$ is an anion such as chloride, bromide, methylsulfate, sulfate, or the like, to provide electrical neutrality; A is a alkoxy group, especially a ethoxy, propoxy or butoxy group; and p is from 0 to about 30, preferably 2 to about 15, most preferably 2 to about 8.

Preferably the $ApR^4$ group in formula I has p=1 and is a hydroxyalkyl group, having no greater than 6 carbon atoms whereby the —OH group is separated from the quaternary ammonium nitrogen atom by no more than 3 carbon atoms. Particularly preferred $ApR^4$ groups are —$CH_2CH_2OH$, —$CH_2CH_2CH_2OH$, —$CH_2CH(CH_3)OH$ and —$CH(CH_3)CH_2OH$, with —$CH_2CH_2OH$ being particularly preferred. Preferred $R^1$ groups are linear alkyl groups. Linear $R^1$ groups having from 8 to 14 carbon atoms are preferred.

Another highly preferred cationic mono-alkoxylated amine surfactants for use herein are of the formula

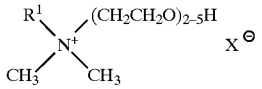

wherein $R^1$ is $C_{10}$–$C_{18}$ hydrocarbyl and mixtures thereof, especially $C_{10}$–$C_{14}$ alkyl, preferably $C_{10}$ and $C_{12}$ alkyl, and X is any convenient anion to provide charge balance, preferably chloride or bromide.

As noted, compounds of the foregoing type include those wherein the ethoxy ($CH_2CH_2O$) units (EO) are replaced by butoxy, isopropoxy [$CH(CH_3)CH_2O$] and [$CH_2CH(CH_3O$] units (i-Pr) or n-propoxy units (Pr), or mixtures of EO and/or Pr and/or i-Pr units.

The levels of the cationic mono-alkoxylated amine surfactants used in detergent compositions of the invention is preferably from 0.1% to 20%, more preferably from 0.2% to 7%, most preferably from 0.3% to 3.0% by weight of the composition.

Cationic Bis-alkoxylated Amine Surfactant

The cationic bis-alkoxylated amine surfactant preferably has the general formula II:

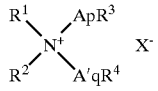

(II)

wherein $R^1$ is an alkyl or alkenyl moiety containing from about 8 to about 18 carbon atoms, preferably 10 to about 16 carbon atoms, most preferably from about 10 to about 14 carbon atoms; $R^2$ is an alkyl group containing from one to three carbon atoms, preferably methyl; $R^3$ and $R^4$ can vary independently and are selected from hydrogen (preferred), methyl and ethyl, $X^-$ is an anion such as chloride, bromide, methylsulfate, sulfate, or the like, sufficient to provide electrical neutrality. A and A' can vary independently and are each selected from $C_1$–$C_4$ alkoxy, especially ethoxy, (i.e., —$CH_2CH_2O$—), propoxy, butoxy and mixtures thereof; p is from 1 to about 30, preferably 1 to about 4 and q is from 1 to about 30, preferably 1 to about 4, and most preferably both p and q are 1.

Highly preferred cationic bis-alkoxylated amine surfactants for use herein are of the formula

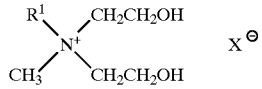

wherein $R^1$ is $C_{10}$–$C_{18}$ hydrocarbyl and mixtures thereof, preferably $C_{10}$, $C_{12}$, $C_{14}$ alkyl and mixtures thereof. X is any convenient anion to provide charge balance, preferably chloride. With reference to the general cationic bis-alkoxylated amine structure noted above, since in a preferred compound $R^1$ is derived from (coconut) $C_{12}$–$C_{14}$ alkyl fraction fatty acids, $R^2$ is methyl and $ApR^3$ and $A'qR^4$ are each monoethoxy.

Other cationic bis-alkoxylated amine surfactants useful herein include compounds of the formula:

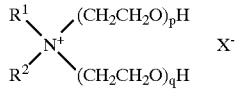

wherein $R^1$ is $C_{10}$–$C_{18}$ hydrocarbyl, preferably $C_{10}$–$C_{14}$ alkyl, independently p is 1 to about 3 and q is 1 to about 3, $R^2$ is $C_1$–$C_3$ alkyl, preferably methyl, and X is an anion, especially chloride or bromide.

Other compounds of the foregoing type include those wherein the ethoxy ($CH_2CH_2O$) units (EO) are replaced by butoxy (Bu) isopropoxy [$CH(CH_3)CH_2O$] and [$CH_2CH(CH_3O$] units (i-Pr) or n-propoxy units (Pr), or mixtures of EO and/or Pr and/or i-Pr units.

Perhydrate Bleaches

An preferred additional components of the components or compositions is a perhydrate bleach, such as metal perborates, metal percarbonates, particularly the sodium salts. Perborate can be mono or tetra hydrated. Sodium percarbonate has the formula corresponding to $2Na_2CO_3.3H_2O_2$, and is available commercially as a crystalline solid.

Potassium peroxymonopersulfate, sodium per is another optional inorganic perhydrate salt of use in the detergent components or compositions herein.

Organic Peroxyacid Bleaching System

A preferred feature of the components or compositions is an organic peroxyacid bleaching system. In one preferred execution the bleaching system contains a hydrogen peroxide source and an organic peroxyacid bleach precursor compound. The production of the organic peroxyacid occurs by an in situ reaction of the precursor with a source of hydrogen peroxide. Preferred sources of hydrogen peroxide include inorganic perhydrate bleaches, such as the perborate bleach of the claimed invention. In an alternative preferred execution a preformed organic peroxyacid is incorporated directly into the components or compositions. Components or compositions containing mixtures of a hydrogen peroxide source and organic peroxyacid precursor in combination with a preformed organic peroxyacid are also envisaged.

Peroxyacid Bleach Precursor

Peroxyacid bleach precursors are compounds which react with hydrogen peroxide in a perhydrolysis reaction to produce a peroxyacid. Generally peroxyacid bleach precursors may be represented as

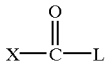

where L is a leaving group and X is essentially any functionality, such that on perhydroloysis the structure of the peroxyacid produced is

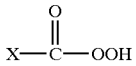

Peroxyacid bleach precursor compounds are preferably incorporated at a level of from 0.5% to 20% by weight, more preferably from 1% to 15% by weight, most preferably from 1.5% to 10% by weight of the detergent compositions.

Suitable peroxyacid bleach precursor compounds typically contain one or more N— or O-acyl groups, which precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-01 70386.

Leaving Groups

The leaving group, hereinafter L group, must be sufficiently reactive for the perhydrolysis reaction to occur within the optimum time frame (e.g., a wash cycle). However, if L is too reactive, this activator will be difficult to stabilize for use in a bleaching components or compositions.

Preferred L groups are selected from the group consisting of:

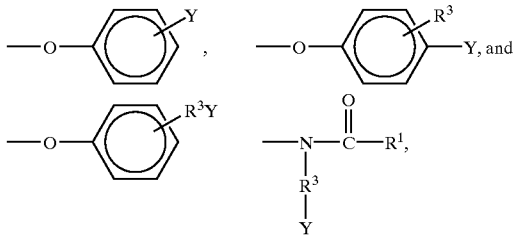

-continued

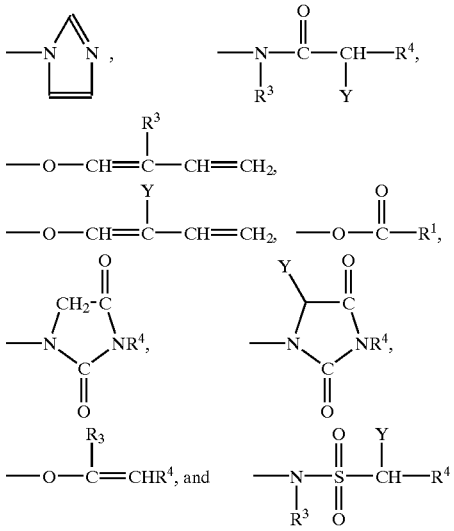

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammmonium groups.

The preferred solubilizing groups are $—SO_3^-M^+$, $—CO_2^-M^+$, $—SO_4^-M^+$, $—N^+(R^3)_4X^-$ and $O←N(R^3)_3$ and most preferably $—SO_3^-M^+$ and $—CO_2^-M^+$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Alkyl Percarboxylic Acid Bleach Precursors

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the $N,N,N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and pentaacetyl glucose.

Amide Substituted Alkyl Peroxyacid Precursors

Amide substituted alkyl peroxyacid precursor compounds are suitable herein, including those of the following general formulae:

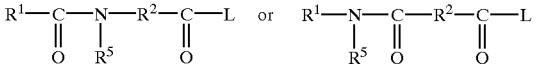

wherein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L can be essentially any leaving group. Amide substituted bleach activator compounds of this type are described in EP-A-0170386.

Preformed Organic Peroxyacid

The detergent composition may contain, in addition to, or as an alternative to, an organic peroxyacid bleach precursor compound, a preformed organic peroxyacid, typically at a level of from 1% to 15% by weight, more preferably from 1% to 10% by weight of the composition.

A preferred class of organic peroxyacid compounds are the amide substituted compounds of the following general formulae:

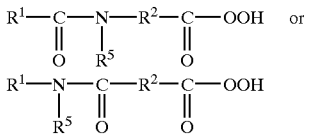

wherein $R^1$ is an alkyl, aryl or alkaryl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms. Amide substituted organic peroxyacid compounds of this type are described in EP-A-01 70386.

Other organic peroxyacids include diacyl and tetraacylperoxides, especially diperoxydodecanedioc acid, diperoxytetradecanedioc acid and diperoxyhexadecanedioc acid. Mono- and diperazelaic acid, mono- and diperbrassylic acid and N-phthaloylaminoperoxicaproic acid are also suitable herein.

Water-Soluble Builder Compound

The components or compositions in accord with the present invention preferably contain a water-soluble builder compound, typically present in detergent compositions at a level of from 1% to 80% by weight, preferably from 10% to 60% by weight, most preferably from 15% to 40% by weight of the composition.

The detergent components or compositions of the invention preferably comprise phosphate-containing builder material. Preferably present at a level of from 0.5% to 60%, more preferably from 5% to 50%, more preferably from 8% to 40.

The phosphate-containing builder material preferably comprises tetrasodium pyrophosphate or even more preferably anhydrous sodium tripolyphosphate.

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, borates, and mixtures of any of the foregoing.

The carboxylate or polycarboxylate builder can be momomeric or oligomeric in type although monomeric polycarboxylates are generally preferred for reasons of cost and performance.

Suitable carboxylates containing one carboxy group include the water soluble salts of lactic acid, glycolic acid and ether derivatives thereof Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates or their acids containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447. The most preferred polycarboxylic acid containing three carboxy groups is citric acid, preferably present at a level of from 0.1% to 15%, more preferably from 0.5% to 8% by weight of the composition.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000. Preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as useful builder components.

Borate builders, as well as builders containing borate-forming materials that can produce borate under detergent storage or wash conditions are useful water-soluble builders herein.

Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Partially Soluble or Insoluble Builder Compound

The components or compositions in accord with the present invention may contain a partially soluble or insoluble builder compound, typically present in detergent compositions at a level of from 0.5% to 60% by weight, preferably from 5% to 50% by weight, most preferably from 8% to 40% weight of the composition.

Examples of largely water insoluble builders include the sodium aluminosilicates.

Suitable aluminosilicate zeolites have the unit cell formula $Na_z[(AlO_2)_z(SiO_2)y].xH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

The aluminosilicate zeolites can be naturally occurring materials, but are preferably synthetically derived. Synthetic crystalline aluminosilicate ion exchange materials are available under the designations Zeolite A, Zeolite B, Zeolite P, Zeolite X, Zeolite HS and mixtures thereof. Zeolite A has the formula:

$$Na_{12}[AlO_2)_{12}(SiO_2)_{12}].xH_2O$$

wherein x is from 20 to 30, especially 27. Zeolite X has the formula $Na_{86}$ $[(AlO_2)_{86}(SiO_2)_{106}].276$ $H_2O$.

Another preferred aluminosilicate zeolite is zeolite MAP builder. The zeolite MAP can be present at a level of from 1% to 80%, more preferably from 15% to 40% by weight of the compositions.

Zeolite MAP is described in EP 384070A (Unilever). It is defined as an alkali metal alumino-silicate of the zeolite P type having a silicon to aluminium ratio not greater than 1.33, preferably within the range from 0.9 to 1.33 and more preferably within the range of from 0.9 to 1.2.

Of particular interest is zeolite MAP having a silicon to aluminium ratio not greater than 1.15 and, more particularly, not greater than 1.07.

In a preferred aspect the zeolite MAP detergent builder has a particle size, expressed as a $d_{50}$ value of from 1.0 to 10.0 micrometres, more preferably from 2.0 to 7.0 micrometres, most preferably from 2.5 to 5.0 micrometres.

The $d_{50}$ value indicates that 50% by weight of the particles have a diameter smaller than that figure. The particle size may, in particular be determined by conventional analytical techniques such as microscopic determination using a scanning electron microscope or by means of a laser granulometer. Other methods of establishing $d_{50}$ values are disclosed in EP 384070A.

Heavy Metal Ion Sequestrant

The components or compositions of the invention preferably contain as an optional component a heavy metal ion sequestrant. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 10%, preferably from 0.1 % to 5%, more preferably from 0.25% to 7.5% and most preferably from 0.3% to 2% by weight of the compositions or component Suitable heavy metal ion sequestrants for use herein include organic phosphonates, such as the amino alkylene poly (alkylene phosphonates), alkali metal ethane 1-hydroxy disphosphonates and nitrilo trimethylene phosphonates.

Preferred among the above species are diethylene triamine penta (methylene phosphonate), ethylene diamine tri (methylene phosphonate) hexamethylene diamine tetra (methylene phosphonate) and hydroxy-ethylene 1,1 diphosphonate, 1,1 hydroxyethane diphosphonic acid and 1,1 hydroxyethane dimethylene phosphonic acid.

Other suitable heavy metal ion sequestrant for use herein include nitrilotriacetic acid and polyaminocarboxylic acids such as ethylenediaminotetracetic acid, ethylenediamine disuccinic acid, ethylenediamine diglutaric acid, 2-hydroxypropylenediamine disuccinic acid or any salts thereof.

Other suitable heavy metal ion sequestrants for use herein are iminodiacetic acid derivatives such as 2-hydroxyethyl diacetic acid or glyceryl imino diacetic acid, described in EP-A-317,542 and EP-A-399,133. The iminodiacetic acid-N-2-hydroxypropyl sulfonic acid and aspartic acid N-carboxymethyl N-2-hydroxypropyl-3-sulfonic acid sequestrants described in EP-A-516,102 are also suitable herein. The β-alanine-N,N'-diacetic acid, aspartic acid-N,N'-diacetic acid, aspartic acid-N-monoacetic acid and iminodisuccinic acid sequestrants described in EP-A-509,382 are also suitable.

EP-A-476,257 describes suitable amino based sequestrants. EP-A-510,331 describes suitable sequestrants derived from collagen, keratin or casein. EP-A-528,859 describes a suitable alkyl iminodiacetic acid sequestrant. Dipicolinic acid and 2-phosphonobutane-1,2,4-tricarboxylic acid are alos suitable. Glycinamide-N,N'-disuccinic acid (GADS), ethylenediamine-N-N'-diglutaric acid (EDDG) and 2-hydroxypropylenediamine-N-N'-disuccinic acid (HPDDS) are also suitable.

Especially preferred are diethylenetriamine pentacetic acid, ethylenediamine-N,N'-disuccinic acid (EDDS) and 1,1 hydroxyethane diphosphonic acid or the alkali metal, alkaline earth metal, ammonium, or substituted ammonium salts thereof, or mixtures thereof.

Enzyme

Another preferred ingredient useful in the components or compositions herein is one or more additional enzymes.

Preferred additional enzymatic materials include the commercially available lipases, cutinases, amylases, neutral and alkaline proteases, cellulases, endolases, esterases, pectinases, lactases and peroxidases conventionally incorporated into detergent components or compositionss. Suitable enzymes are discussed in U.S. Pat. Nos. 3,519,570 and 3,533,139.

Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Protease enzyme may be incorporated into the compositions in accordance with the invention at a level of from 0.0001% to 4% active enzyme by weight of the composition.

Preferred amylases include, for example, α-amylases obtained from a special strain of B licheniformis, described in more detail in GB-1,269,839 (Novo). Preferred commercially available amylases include for example, those sold under the tradename Rapidase by Gist-Brocades, and those sold under the tradename Termamyl, Duramyl and BAN by Novo Industries A/S. Highly preferred amylase enzymes maybe those described in PCT/US 9703635, and in WO95/26397 and WO96/23873.

Amylase enzyme may be incorporated into the composition in accordance with the invention at a level of from 0.0001 % to 2% active enzyme by weight of the composition.

Lipolytic enzyme may be present at levels of active lipolytic enzyme of from 0.0001% to 2% by weight, preferably 0.001% to 1% by weight, most preferably from 0.001% to 0.5% by weight of the compositions.

The lipase may be fungal or bacterial in origin being obtained, for example, from a lipase producing strain of Humicola sp., Thermomyces sp. or Pseudomonas sp. including *Pseudomonas pseudoalcaligenes* or *Pseudomas fluorescens*. Lipase from chemically or genetically modified mutants of these strains are also useful herein. A preferred lipase is derived from *Pseudomonas pseudoalcaligenes,* which is described in Granted European Patent, EP-B-0218272.

Another preferred lipase herein is obtained by cloning the gene from *Humicola lanuginosa* and expressing the gene in *Aspergillus oryza,* as host, as described in European Patent Application, EP-A-0258 068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989.

Organic Polymeric Compound

Organic polymeric compounds are preferred additional components of the components or compositions herein and are preferably present as components of any particulate components where they may act such as to bind the particulate component together. By organic polymeric compound it is meant herein essentially any polymeric organic compound commonly used as dispersants, and anti-redeposition and soil suspension agents in detergent components or compositionss, including any of the high molecular weight organic polymeric compounds described as clay flocculating agents herein, including quaternised ethoxylated (poly) amine clay-soil removal/anti-redeposition agent in accord with the invention.

Organic polymeric compound is typically incorporated in the detergent compositions of the invention at a level of from 0.01% to 30%, preferably from 0.1% to 15%, most preferably from 0.5% to 10% by weight of the compositions.

Examples of organic polymeric compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of M Wt 1000-5000 and their copolymers with maleic anhydride, such copolymers having a molecular weight of from 2000 to 100,000, especially 40,000 to 80,000.

The polyamino compounds are useful herein including those derived from aspartic acid such as those disclosed in EP-A-305282, EP-A-305283 and EP-A-351629.

Terpolymers containing monomer units selected from maleic acid, acrylic acid, polyaspartic acid and vinyl alcohol, particularly those having an average molecular weight of from 5,000 to 10,000, are also suitable herein.

Other organic polymeric compounds suitable for incorporation in the detergent components or compositionss herein include cellulose derivatives such as methylcellulose, carboxymethylcellulose, hydroxypropylmethylcellulose and hydroxyethylcellulose.

Further useful organic polymeric compounds are the polyethylene glycols, particularly those of molecular weight 1000–10000, more particularly 2000 to 8000 and most preferably about 4000.

Highly preferred polymeric components herein are cotton and non-cotton soil release polymer according to U.S. Pat. No. 4,968,451, Scheibel et al., and U.S. Pat. No. 5,415,807, Gosselink et al., and in particular according to U.S. application No. 60/051517.

Another organic compound, which is a preferred clay dispersant/anti-redeposition agent, for use herein, can be the ethoxylated cationic monoamines and diamines of the formula:

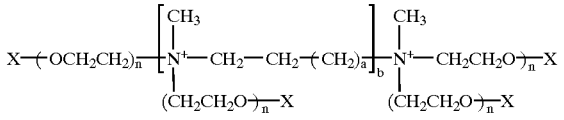

wherein X is a nonionic group selected from the group consisting of H, $C_1$–$C_4$ alkyl or hydroxyalkyl ester or ether groups, and mixtures thereof, a is from 0 to 20, preferably from 0 to 4 (e.g. ethylene, propylene, hexamethylene) b is 1 or 0; for cationic monoamines (b=0), n is at least 16, with a typical range of from 20 to 35; for cationic diamines (b=1), n is at least about 12 with a typical range of from about 12 to about 42.

Other dispersants/anti-redeposition agents for use herein are described in EP-B-01 1965 and U.S. Pat. Nos. 4,659,802 and 4,664,848.

Suds Suppressing System

The detergent compositions of the invention, when formulated for use in machine washing compositions, may comprise a suds suppressing system present at a level of from 0.01% to 15%, preferably from 0.02% to 10%, most preferably from 0.05% to 3% by weight of the composition.

Suitable suds suppressing systems for use herein may comprise essentially any known antifoam compound, including, for example silicone antifoam compounds and 2-alkyl alcanol antifoam compounds.

By antifoam compound it is meant herein any compound or mixtures of compounds which act such as to depress the foaming or sudsing produced by a solution of a detergent composition, particularly in the presence of agitation of that solution.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types. Preferred silicone antifoam compounds are the siloxanes, particularly the polydimethylsiloxanes having trimethylsilyl end blocking units.

Other suitable antifoam compounds include the monocarboxylic fatty acids and soluble salts thereof. These materials are described in U.S. Pat. No. 2,954,347, issued Sep. 27, 1960 to Wayne St. John. The monocarboxylic fatty acids, and salts thereof, for use as suds suppressor typically have hydrocarbyl chains of 10 to 24 carbon atoms, preferably 12 to 18 carbon atoms. Suitable salts include the alkali metal salts such as sodium, potassium, and lithium salts, and ammonium and alkanolammonium salts.

Other suitable antifoam compounds include, for example, high molecular weight fatty esters (e.g. fatty acid triglycerides), fatty acid esters of monovalent alcohols, aliphatic $C_{18}$–$C_{40}$ ketones (e.g. stearone) N-alkylated amino triazines such as tri- to hexa-alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostearyl di-alkali metal (e.g. sodium, potassium, lithium) phosphates and phosphate esters.

A preferred suds suppressing system comprises:

(a) antifoam compound, preferably silicone antifoam compound, most preferably a silicone antifoam compound comprising in combination
  (i) polydimethyl siloxane, at a level of from 50% to 99%, preferably 75% to 95% by weight of the silicone antifoam compound; and
  (ii) silica, at a level of from 1% to 50%, preferably 5% to 25% by weight of the silicone/silica antifoam compound;
  wherein said silica/silicone antifoam compound is incorporated at a level of from 5% to 50%, preferably 10% to 40% by weight;

(b) a dispersant compound, most preferably comprising a silicone glycol rake copolymer with a polyoxyalkylene content of 72-78% and an ethylene oxide to propylene oxide ratio of from 1:0.9 to 1:1.1, at a level of from 0.5% to 10%, preferably 1% to 10% by weight; a particularly preferred silicone glycol rake copolymer of this type is DCO544, commercially available from DOW Corning under the tradename DCO544;

(c) an inert carrier fluid compound, most preferably comprising a $C_{16}$–$C_{18}$ ethoxylated alcohol with a degree of ethoxylation of from 5 to 50, preferably 8 to 15, at a level of from 5% to 80%, preferably 10% to 70%, by weight;

A highly preferred particulate suds suppressing system is described in EP-A-0210731 and comprises a silicone antifoam compound and an organic carrier material having a melting point in the range 50° C. to 85° C., wherein the organic carrier material comprises a monoester of glycerol and a fatty acid having a carbon chain containing from 12 to 20 carbon atoms. EP-A-02 10721 discloses other preferred particulate suds suppressing systems wherein the organic carrier material is a fatty acid or alcohol having a carbon chain containing from 12 to 20 carbon atoms, or a mixture thereof, with a melting point of from 45° C. to 80° C.

Other highly preferred suds suppressing systems comprise polydimethylsiloxane or mixtures of silicone, such as polydimethylsiloxane, aluminosilicate and polycarboxylic polymers, such as copolymers of laic and acrylic acid.

Polymeric Dye Transfer Inhibiting Agents

The compositions herein may also comprise from 0.01% to 10 %, preferably from 0.05% to 0.5% by weight of polymeric dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidonepolymers or combinations thereof, whereby these polymers can be cross-linked polymers.

Optical Brightener

The compositions herein also optionally contain from about 0.005% to 5% by weight of certain types of hydrophilic optical brighteners.

Hydrophilic optical brighteners useful herein include those having the structural formula:

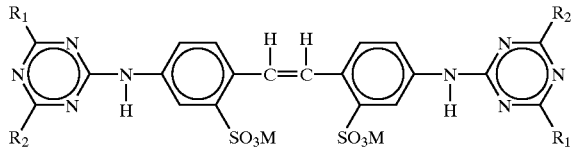

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-CBS-X and Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R^1$ is anilino. $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species are commercially marketed under the tradename Tinopal-DMS-X and Tinopal AMS-GX by Ciba Geigy Corporation.

Polymeric Soil Release Agent

Additional polymeric soil release agents, hereinafter "SRA", can optionally be employed in the present compositions. If utilized, SRA's will generally comprise from 0.01% to 10.0%, typically from 0.1% to 5%, preferably from 0.2% to 3.0% by weight, of the compositions.

The additional SRP's include hydrophivally modified cellulose derivatives, such as ester derivatives of CMC. Also included are nonionic cellulose ethers and derivatives.

Preferred SRA's typically have hydrophilic segments to hydrophilize the surface of hydrophobic fibers such as polyester and nylon, and hydrophobic segments to deposit upon hydrophobic fibers and remain adhered thereto through completion of washing and rinsing cycles, thereby serving as an anchor for the hydrophilic segments. This can enable stains occurring subsequent to treatment with the SRA to be more easily cleaned in later washing procedures.

Preferred SRA's include oligomeric terephthalate esters, typically prepared by processes involving at least one transesterification/oligomerization, often with a metal catalyst such as a titanium(IV) alkoxide. Such esters may be made using additional monomers capable of being incorporated into the ester structure through one, two, three, four or more positions, without, of course, forming a densely crosslinked overall structure.

Suitable SRA's include a sulfonated product of a substantially linear ester oligomer comprised of an oligomeric ester backbone of terephthaloyl and oxyalkyleneoxy repeat units and allyl-derived sulfonated terminal moieties covalently attached to the backbone, for example as described in U.S. Pat. No. 4,968,451, Nov. 6, 1990 to J. J. Scheibel and E. P. Gosselink. Such ester oligomers can be prepared by: (a) ethoxylating allyl alcohol; (b) reacting the product of (a) with dimethyl terephthalate ("DMT") and 1,2-propylene glycol ("PG") in a two-stage transesterification/oligomerization procedure; and (c) reacting the product of (b) with sodium metabisulfite in water. Other SRA's include the nonionic end-capped 1,2-propylene/polyoxyethylene terephthalate polyesters of U.S. Pat. No. 4,711,730, Dec. 8, 1987 to Gosselink et al., for example those produced by transesterification/oligomerization of poly(ethyleneglycol) methyl ether, DMT, PG and poly(ethyleneglycol) ("PEG"). Other examples of SRA's include: the partly- and fully-anionic-end-capped oligomeric esters of U.S. Pat. No. 4,721,580, Jan. 26, 1988 to Gosselink, such as oligomers from ethylene glycol ("EG"), PG, DMT and Na-3,6-dioxa-8-hydroxyoctanesulfonate; the nonionic-capped block polyester oligomeric compounds of U.S. Pat. No. 4,702,857, Oct. 27, 1987 to Gosselink, for example produced from DMT, methyl (Me)-capped PEG and EG and/or PG, or a combination of DMT, EG and/or PG, Me-capped PEG and Na-dimethyl-5-sulfoisophthalate; and the anionic, especially sulfoaroyl, end-capped terephthalate esters of U.S. Pat. No. 4,877,896, Oct. 31, 1989 to Maldonado, Gosselink et al., the latter being typical of SRA's useful in both laundry and fabric conditioning products, an example being an ester composition made from m-sulfobenzoic acid monosodium salt, PG and DMT, optionally but preferably further comprising added PEG, e.g., PEG 3400.

SRA's also include: simple copolymeric blocks of ethylene terephthalate or propylene terephthalate with polyethylene oxide or polypropylene oxide terephthalate, see U.S. Pat. No. 3,959,230 to Hays, May 25, 1976 and U.S. Pat. No. 3,893,929 to Basadur, Jul. 8, 1975; cellulosic derivatives such as the hydroxyether cellulosic polymers available as METHOCEL from Dow; the $C_1$–$C_4$ alkyl celluloses and $C_4$ hydroxyalkyl celluloses, see U.S. Pat. No. 4,000,093, Dec. 28, 1976 to Nicol, et al.; and the methyl cellulose ethers having an average degree of substitution (methyl) per anhydroglucose unit from about 1.6 to about 2.3 and a solution viscosity of from about 80 to about 120 centipoise measured at 20° C. as a 2% aqueous solution. Such materials are available as METOLOSE SM100 and METOLOSE SM200, which are the trade names of methyl cellulose ethers manufactured by Shin-etsu Kagaku Kogyo KK.

Additional classes of SRA's include: (I) nonionic terephthalates using diisocyanate coupling agents to link polymeric ester structures, see U.S. Pat. No. 4,201,824, Violland et al. and U.S. Pat. No. 4,240,918 Lagasse et al.; and (II) SRA's with carboxylate terminal groups made by adding trimellitic anhydride to known SRA's to convert terminal hydroxyl groups to trimellitate esters. With the proper selection of catalyst, the trimellitic anhydride forms linkages to the terminals of the polymer through an ester of the isolated carboxylic acid of trimellitic anhydride rather than by opening of the anhydride linkage. Either nonionic or anionic SRA's may be used as starting materials as long as they have hydroxyl terminal groups which may be esterified. See U.S. Pat. No. 4,525,524 Tung et al. Other classes include: (III) anionic terephthalate-based SRA's of the urethane-linked variety, see U.S. Pat. No. 4,201,824, Violland et al.;

Other Optional Ingredients

Other optional ingredients suitable for inclusion in the components or compositionss of the invention include perfumes, colours and filler salts, with sodium sulfate being a preferred filler salt.

Highly preferred compositions contain from about 2% to about 10% by weight of an organic acid, preferably citric acid. Also, preferably combined with a carbonate salt, minor amounts (e.g., less than about 20% by weight) of neutralizing agents, buffering agents, phase regulants, hydrotropes, enzyme stabilizing agents, polyacids, suds regulants, opacifiers, anti-oxidants, bactericides and dyes, such as those described in U.S. Pat. No. 4.285,841 to Barrat et al., issued Aug. 25, 1981 (herein incorporated by reference), can be present.

Form of the Components or Compositionss

The components or compositions herein can take a variety of physical forms including liquid and solid forms such as tablet, flake, pastille and bar, and preferably granular forms. The components or compositions can be made via a variety of methods, depending on their product form. The solid compositions or components can be made by methods such as dry-mixing, agglomerating, compaction, or spray-drying of the various compounds comprised in the detergent component, or mixtures of these techniques.

It is highly preferred that the cyclic amine based polymers and the anionic cellulose materials herein are present in an intimate mixture. In solid compositins hor components herein, this mixture can be obtained by any mixing method, including agglomeration. The intimate mixture are preferably in the form of a compacted, agglomerated or spray dried granule.

Detergent compositions and components herein preferably have a bulk density of from 300 g/liter or even 350 g/liter or 450 g/liter to preferably 1500 g/liter or 1000 g/liter or even to 850 g/liter.

Fabric Laundering Method

The present invention also provides a method for laundering. Such a method employs contacting these fabrics with an aqueous washing solution formed from an effective amount of the detergent components or compositions herein before described or formed from the individual components of such components or compositions. Contacting of fabrics with washing solution will generally occur under conditions of agitation although the components or compositions of the present invention may also be used to form aqueous unagitated soaking solutions for fabric cleaning and treatment. As discussed above, it is preferred that the washing solution have a pH of less than about 11.0, preferably it has a pH of less than 10.5 and most preferably it has a pH of less than 9.5.

An effective amount of a high density liquid or granular detergent components or compositions in the aqueous wash solution in the washing machine is preferably from about 500 to about 10000 ppm or even 7000 ppm, more preferably from about 1000 to about 3000 ppm.

Fabric Conditioning and Softening

The detergent components or compositions herein may also be used to treat and condition fabrics and textiles. Thus, for example, a fabric conditioning components or compositions comprising the cyclic amine based polymers and anionic cellulose polymers as described herein, may be added during the rinse cycle of a conventional home laundering operation in order to impart the desired fabric appearance and integrity benefits hereinbefore described. Then, preferably at least about 1%, preferably from about 10%, more preferably from about 20% to about 80%, more preferably to about 60% by weight, of the composition or component is one or more fabric softener actives, such as cationically charged hydrocarbons, such as C12–C22 dialkyl substitued quaternary ammonium salts and/or clays, optionaly with a flocculating polymer.

Alternatively, the composition or component herein may be present in or in the form of a softening and cleaning composition, such as for example described in EP-B1-313146 and WO93/01267, preferably comprising additional softening ingredients, such as clay and optionally a flocculating polymer.

The following are chemical structures for certain cyclic amine based polymers herein, prepared as described in co-pending applications PCT/US98/19143 and PCT/US98/19142. Side reactions expected to occur during the condensation are not shown.

TABLE 1

| Example | Material |
|---|---|
| 1 | Adduct of Imidazole-epichlorohydrin<br>(Ratio of imidazole:epichlorohydrin 1:1, Polymer from Example 1)<br> 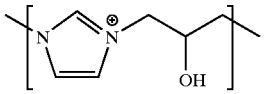 <br>(Idealized Structure) |

TABLE 1-continued

| Example | Material |
|---|---|
| 2 | Adduct of Imidazole-epichlorohydrin (Ratio of imidazole:epichlorohydrin 1.36:1, Polymer from Example 2) 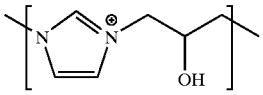 (Idealized Structure) |
| 3 | Adduct of Imidazole-epichlorohydrin (Ratio of imidazole:epichlorohydrin 1.75:1) 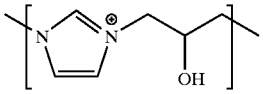 (Idealized Structure) |
| 4 | Adduct of Imidazole-epichlorohydrin-trisglycidyl ether from glycerine (Ratio of imidazole:epichlorohydrin:trisglycidylether 2.0:1.76:0.26) 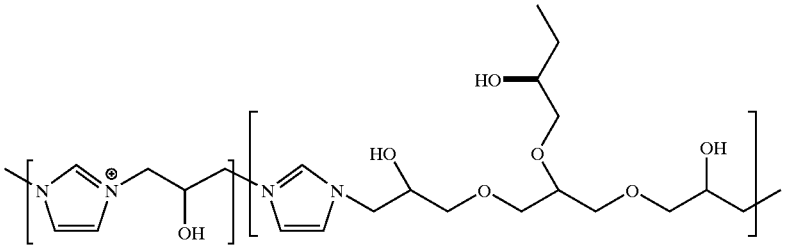 Idealized Structure |
| 5 | Adduct of Imidazole-epichlorohydrin- -trisglycidyl ether from glycerine(Ratio of imidazole:epichlorohydrin:-trisglycidyl ether from glycerine 2.0:1.9:0.1) 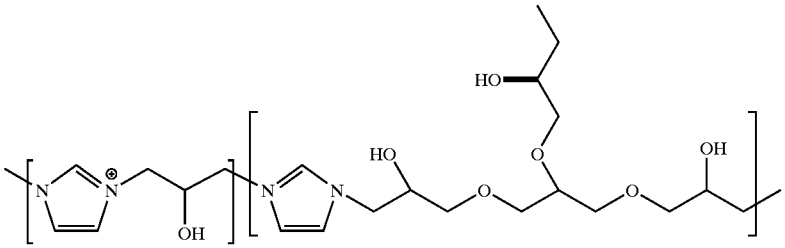 |
| 6 | Adduct of piperazine and epichlorohydrin (ratio 1:1) 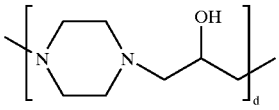 |
| 7 | Adduct of piperazine and epichlorohydrin (ratio 1:1), benzyl quat 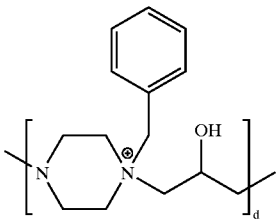 |

TABLE 1-continued

| Example | Material |
|---|---|
| 8 | Adduct of piperazine and epichlorohydrin (ratio 1:1) methyl quat 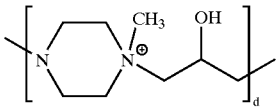 |
| 9 | Adduct of piperazine, morpholine and epichlorohydrin (ratio 0.9:0.4:1.0) 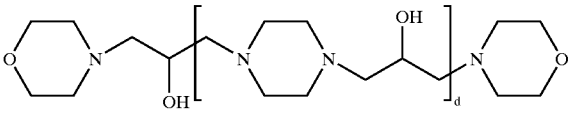 |
| 10 | Adduct of piperazine, piperidine and epichlorohydrin (ratio 0.9:0.4:1.0) 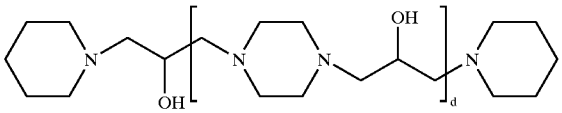 |
| 11 | Adduct of piperazine, morpholine and epichlorohydrin (ratio 0.9:0.4:1.0) methyl quat 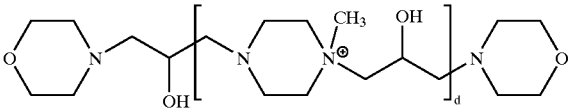 |
| 12 | Adduct of piperazine, piperidine and epichlorohydrin (ratio 0.9:0.4:1.0) methyl quat 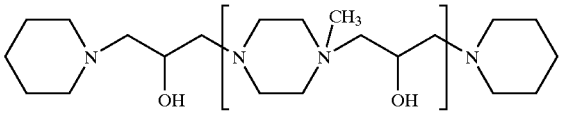 |
| 13 | Adduct of piperazine, morpholine and epichlorohydrin (ratio 0.9:0.4:1.0) benzyl quat 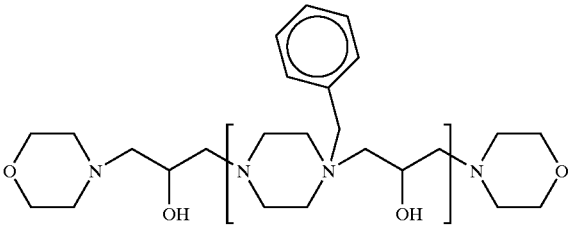 |
| 14 | Adduct of piperazine, piperidine and epichlorohydrin (ratio 0.9:0.4:1.0) benzyl quat 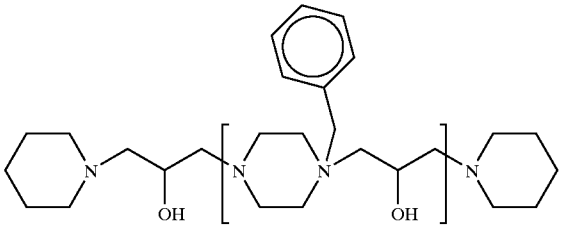 |
| 15 | Adduct of imidazole, piperazine and epichlorohydrin (ratio 2:1:3) 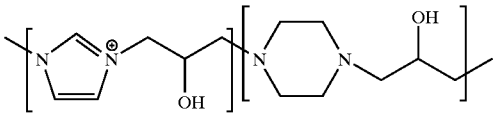 |

TABLE 1-continued

| Example | Material |
|---|---|
| 16 | Adduct of imidazole, piperazine and epichlorohydrin (ratio 1:1:2) 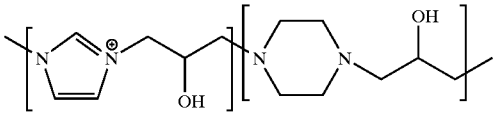 |
| 17 | Adduct of imidazole, 1,6 diaminohexane and epichlorohydrin (ratio 1:1:2) 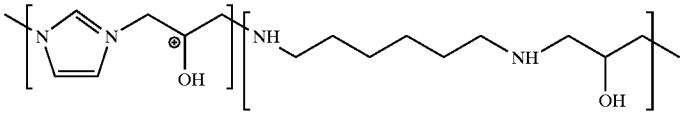 |
| 18 | Adduct of imidazole, dimethylaminopropylamine and epichlorohydrin (ratio 1.02:0.34:1.0) 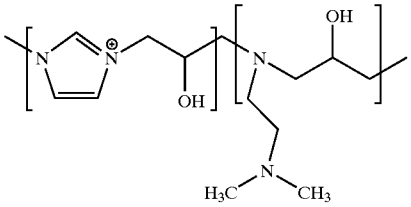 |
| 19 | Adduct of imidazole-epichlorohydrin and chloroacetic acid (Ratio- 1.36:0.97:0.07) 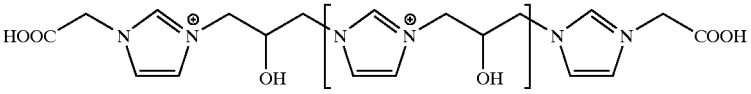 |
| 20 | Adduct of imidazole-epichlorohydrin and chloroacetic acid (Ratio- 1.36:0.93:0.14) 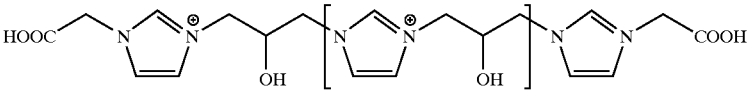 |
| 21 | Adduct of imidazole-epichlorohydrin and chloroacetic acid (Ratio- 1.36:0.83:0.34) 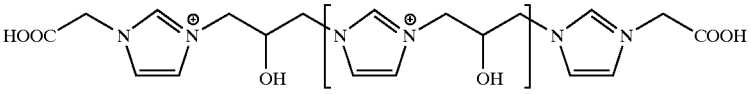 |
| 22 | Adduct of imidazole-epichlorohydrin and 3 chlorohydroxypropyl sulfonic acid (ratio: 1.0:0.83:0.34) 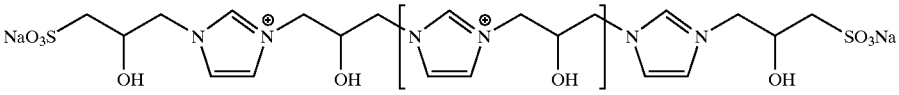 |
| 23 | Adduct of imidazole-epichlorohydrin and 3 chlorohydroxypropyl sulfonic acid (ratio: 1.0:0.75:0.5) 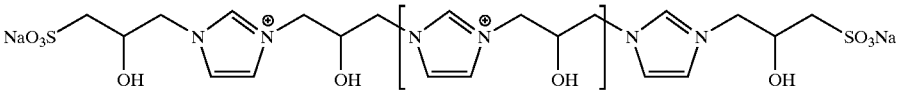 |

TABLE 1-continued

| Example | Material |
|---|---|
| 24 | Adduct of imidazole, piperazine and epichlorohydrin (Ratio- 1.0:1.0:2.0) quat with 0.22 moles of chloroacetate 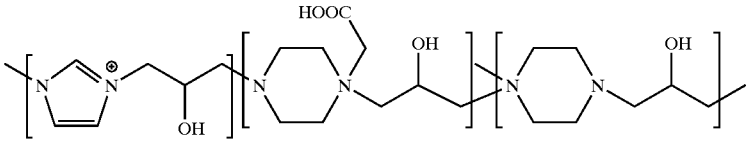 |
| 25 | Adduct of imidazole, piperazine and epichlorohydrin (Ratio- 1.0:3.0:4.0) quat with 0.32 moles of chloroacetate 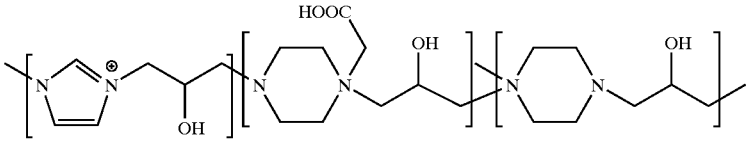 |
| 26 | Adduct of imidazole, piperazine and epichlorohydrin (Ratio- 1.0:1.0:2.0) quat with 0.45 moles of chloroacetate 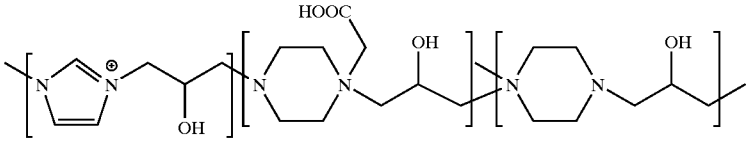 |
| 27 | Adduct of imidazole and epichlorohdrin, (ratio 1.75:1) oxidized 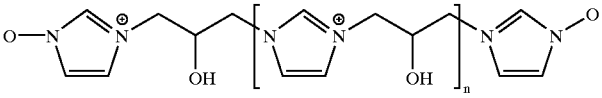 |
| 28 | Adduct of piperazine and epichlorohydrin (ratio 1:1) 100% oxidized 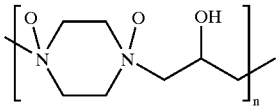 |
| 29 | Adduct of piperazine and epichlorohydrin (ratio 1:1) 50% oxidized 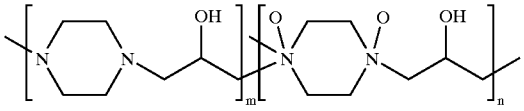 |
| 30 | Adduct of piperazine, morpholine and epichlorohydrin (ratio 1:0.2:1) 100% oxidized 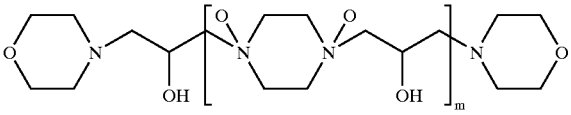 |
| 31 | Adduct of piperazine, morpholine and epichlorohydrin (ratio 1:0.2:1) 25% methyl quat and oxidized 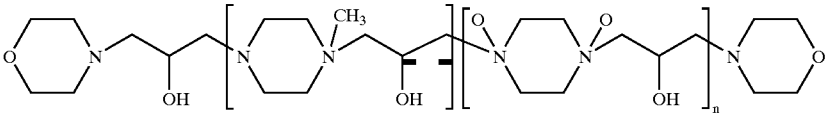 |

TABLE 1-continued

| Example | Material |
|---|---|
| 32 | Adduct of imidazole, piperazine and epichlorohydrin (ratio 1:3;4) 100% oxidized 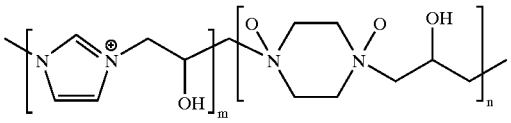 |
| 33 | Adduct of imidazole, piperazine and epichlorohydrin (ration 1:3:4) 50% oxidized 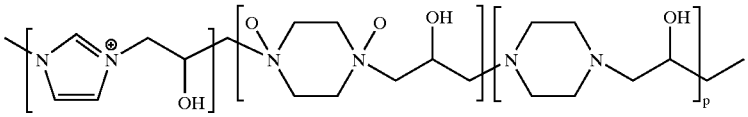 |
| 34 | Adduct of imidazole, piperazine and epichlorohydrin (ration 1:1:2) 100% oxidized 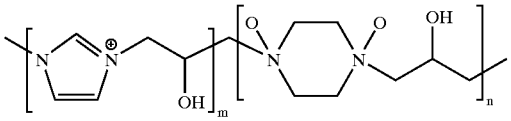 |
| 35 | Adduct of imidazole, piperazine and epichlorohydrin (ration 1:5:6) 100% oxidized 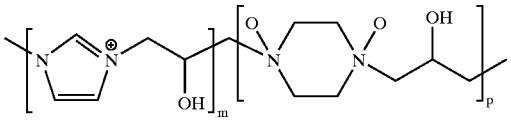 |
| 36 | Adduct of imidazole, piperazine and epichlorohydrin (ration 1:10:11) 100% oxidized 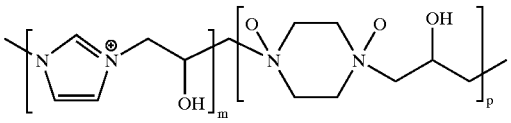 |
| 37 | Adduct of imidazole, piperazine and epichlorohydrin (Ratio-1.0:3.0:4.0) quat with 0.32 moles of chloroacetate and oxidized 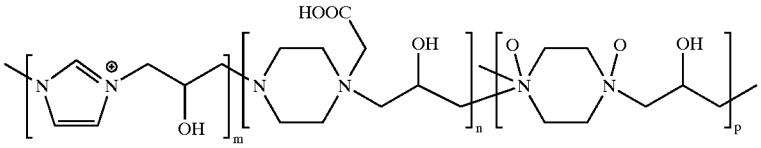 |
| 38 | Adduct of imidazole, piperazine and epichlorohydrin (Ratio-1.0:1.0:2.0) quat with 0.45 moles of chloroacetate and oxidized 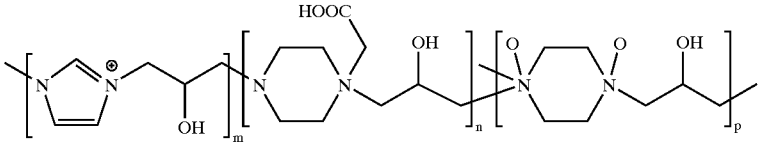 |
| 39 | Adduct of imidazole, piperazine and epichlorohydrin (Ratio-1.0:5.0:6.0) quat with 0.32 moles of chloroacetate and oxidized 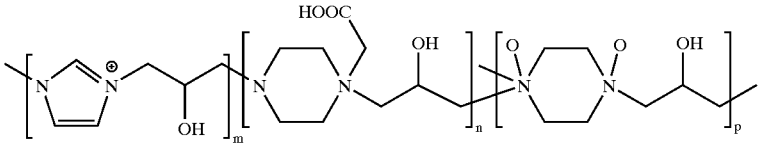 |

TABLE 1-continued

| Example | Material |
|---|---|
| 40 | Adduct of imidazole, piperazine and epichlorohydrin (Ratio-1.0:1.0:2.0) quat with 0.45 moles of dimethyl sulfate and oxidized 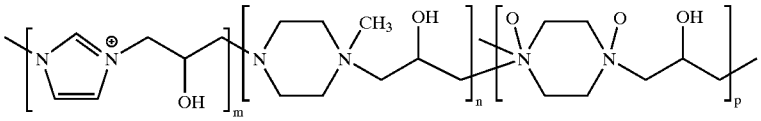 |
| 41 | Adduct of imidazole, dimethylaminopropylamine and epichlorohydrin (ratio 1.02:0.34:1.0) oxidized 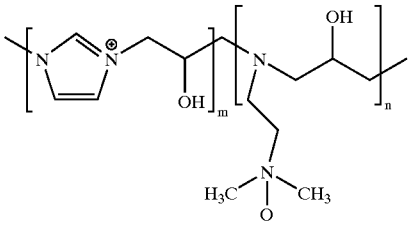 |

Abbrevations used in the Effervescence Component and Detergent Composition Examples LAS: Sodium linear C11–13 alkyl benzene sulfonate LAS (I): Potassium linear or branched C11–13 alkyl benzene sulfonate TAS: Sodium tallow alkyl sulfate CxyAS: Sodium C1x–C1y alkyl sulfate C46SAS: Sodium C14–C16 secondary (2,3) alkyl sulfate CxyEzS: Sodium C1x–C1y alkyl sulfate condensed with z moles of ethylene oxide CxyEz: C1x–C1y predominantly linear primary alcohol condensed with an average of z moles of ethylene oxide QAS1: R2.N+(CH3)2(C2H4OH) with R2=C12–C14

QAS: R2.N+(CH3)2(C2H4OH) with R2=C8–C11

APA: C8–C10 amido propyl dimethyl amine

Soap: Sodium linear alkyl carboxylate derived from an 80/20 mixture of tallow and coconut fatty acids Adduct x: Adduct with number x according to table I STS: Sodium toluene sulphonate CFAA: C12–C14 (coco) alkyl N-methyl glucamide TFAA: C16–C18 alkyl N-methyl glucamide TPKFA: C12–C14 topped whole cut fatty acids STPP: Anhydrous sodium tripolyphosphate TSPP: Tetrasodium pyrophosphate Zeolite A: Hydrated sodium aluminosilicate of formula Na12(AlO2SiO2)12.27H2O having a primary particle size in the range from 0.1 to 10 micrometers (weight expressed on an anhydrous basis)

NaSKS-6: Crystalline layered silicate of formula d-Na2Si2O5

Citric acid I: Anhydrous citric acid.

Citric acid II: Monohydrate citric acid,

Malic acid: Anhydrous malic acid, 80% having a particle size of from 50 microns to 100 microns, having a volume median particle size of 75 microns Maleic acid: Anhydrous maleic acid, 80% having a particle size of from 5 microns to 30 microns, having a volume median particle size of 15 microns Tartaric acid: Anhydrous tartaric acid, 80% having a particle size of from 25 microns to 75 microns, having a volume median particle size of 50 microns Carbonate: Anydrous sodium carbonate Bicarbonate: Anhydrous sodium bicarbonate Silicate: Amorphous sodium silicate (SiO2:Na2O=2.0:1)

Sulfate: Anhydrous sodium sulfate

Mg sulfate: Anhydrous magnesium sulfate

Citrate: Tri-sodium citrate dihydrate of activity 86.4% with a particle size distribution between 425 $\mu$m and 850 $\mu$m MA/AA: Copolymer of 1:4 maleic/acrylic acid, average molecular weight about 70,000

MA/AA (1): Copolymer of 4:6 maleic/acrylic acid, average molecular weight about 10,000

AA: Sodium polyacrylate polymer of average molecular weight 4,500

CMC: Sodium carboxymethyl cellulose

Cellulose ether: Methyl cellulose ether with a degree of polymerization of 650 available from Shin Etsu Chemicals Protease: Proteolytic enzyme, having 3.3% by weight of active enzyme, sold by NOVO Industries A/S under the tradename Savinase Protease I: Proteolytic enzyme, having 4% by weight of active enzyme, as described in WO 95/10591, sold by Genencor Int. Inc.

Alcalase: Proteolytic enzyme, having 5.3% by weight of active enzyme, sold by NOVO Industries A/S Cellulase: Cellulytic enzyme, having 0.23% by weight of active enzyme, sold by NOVO Industries A/S under the tradename Carezyme Amylase: Amylolytic enzyme, having 1.6% by weight of active enzyme, sold by NOVO Industries A/S under the tradename Termamyl 120T Lipase: Lipolytic enzyme, having 2.0% by weight of active enzyme, sold by NOVO Industries A/S under the tradename Lipolase Lipase (1): Lipolytic enzyme, having 2.0% by weight of active enzyme, sold by NOVO Industries A/S under the tradename Lipolase Ultra Endolase: Endoglucanase enzyme, having 1.5% by weight of active enzyme, sold by NOVO Industries A/S PB4: Particle containing sodium perborate tetrahydrate of nominal formula NaBO2.3H2O, the particles having a weight average particle size of 950 microns, 85% particles having a particle size of from 850 microns to 950 microns PB1: Particle containing anhydrous sodium perborate bleach of nominal formula NaBO2.H 2O2, the particles having a weight average particle size of 800 microns, 85% particles having a particle size of from 750 microns to 950 microns Percarbonate: Particle containing sodium percarbonate of nominal formula 2Na2CO3.3H2O2, the particles having a weight average particle size of 850 microns, 5% or less having a particle size of less than 600 microns and 2% or less having a particle size of more than 1180 microns NOBS: Particle comprising nonanoyloxybenzene sulfonate in the form of the sodium salt, the particles having a weight average particle size of 750 microns to 900 microns NAC-OBS Particle comprising (6-nonamidocaproyl) oxybenzene sulfonate, the particles having a weight average particle size of from 825 microns to 875 microns TAED Particle containing tetraacetylethylenediamine, DTPA: Diethylene triamine pentaacetic acid DTPMP: Diethylene triamine penta (methylene phosphonate), marketed by Monsanto under the Tradename Dequest 2060

Photoactivated: Sulfonated zinc phthlocyanine encapsulated in bleach (1) dextrin soluble polymer Photoactivated: Sulfonated alumino phthlocyanine encapsulated in bleach (2) dextrin soluble polymer Brightener 1: Disodium 4,4'-bis(2-sulphostyryl)biphenyl Brightener 2: Disodium 4,4'-bis(4-anilino-6-morpholino-1.3.5-triazin-2-yl)amino) stilbene-2:2'-disulfonate EDDS: Ethylenediamine-N,N'-disuccinic acid, (S,S) isomer in the form of its sodium salt.

HEDP 1,1-hydroxyethane diphosphonic acid

PEGx: Polyethylene glycol, with a molecular weight of x (typically 4,000)

PEO Polyethylene oxide, with an average molecular weight of 50,000

TEPAE: Tetraethylenepentaamine ethoxylate

PVI: Polyvinyl imidosole, with an average molecular weight of 20,000

PVP: Polyvinylpyrolidone polymer, with an average molecular weight of 60,000

PVNO: Polyvinylpyridine N-oxide polymer, with an average molecular weight of 50,000

PVPVI: Copolymer of polyvinylpyrolidone and vinylimidazole, with an average molecular weight of 20,000

QEA: bis((C2H5O)(C2H4O)n)(CH3)—N+—C6H12—N+—(CH3) bis((C2H5O)—(C2H4 O))n, wherein n=from 20 to 30

SRP 1: Anionically end capped poly esters

SRP 2: Diethoxylated poly (1, 2 propylene terephtalate) short block polymer

PEI: Polyethyleneimine with an average molecular weight of 1800 and an average ethoxylation degree of 7 ethyleneoxy residues per nitrogen Silicone antifoam: Polydimethylsiloxane foam controller with siloxane-oxyalkylene copolymer as dispersing agent with a ratio of said foam controller to said dispersing agent of 10:1 to 100:1

Opacifier: Water based monostyrene latex mixture, sold by BASF Aktiengesellschaft under the tradename Lytron 621

Wax: Paraffin wax

Effervescence granule: any of the effervescence granules I to XII

In the following examples all levels are quoted as % by weight of the composition:

TABLE II

The following compositions are in accordance with the invention.

| | A | B | C | D | E | F | G | H | I |
|---|---|---|---|---|---|---|---|---|---|
| Spray-dried Granules | | | | | | | | | |
| LAS | 10.0 | 10.0 | 15.0 | 5.0 | 5.0 | 10.0 | — | — | — |
| STS | — | 1.0 | — | | | | — | — | — |
| MBAS | — | — | | 5.0 | 5.0 | | — | — | — |
| $C_{45}AS$ | — | — | 1.0 | | 2.0 | 2.0 | — | — | — |
| $C_{45}AE_3S$ | — | — | | 1.0 | | | — | — | — |
| Adduct 1 or 2 | 2.0 | 0.5 | 1.0 | 1.0 | 3.0 | 5.0 | 1.0 | 1.5 | 0.2 |
| DTPA, HEDP and/or EDDS | 0.3 | 0.3 | 0.5 | 0.3 | | | — | — | — |
| MgSO4 | 0.5 | 0.5 | 0.1 | — | | | — | — | — |
| Sodium citrate | — | — | — | 3.0 | 5.0 | | — | — | — |
| Sodium carbonate | 10.0 | 7.0 | 15.0 | | | 10.0 | — | — | — |
| Sodium sulphate | 5.0 | 5.0 | — | — | 5.0 | 3.0 | — | — | — |
| Sodium silicate 1.6 R | — | — | — | — | 2.0 | | — | — | — |
| Zeolite A | 16.0 | 18.0 | 20.0 | 20.0 | — | — | — | — | — |
| SKS-6 | — | — | — | 3.0 | 5.0 | — | — | — | — |
| MA/AA or AA | 1.0 | 2.0 | 11.0 | — | — | 2.0 | — | — | — |
| PEG 4000 | — | 2.0 | — | 1.0 | — | 1.0 | — | — | — |
| QEA | 1.0 | — | — | — | 1.0 | — | — | — | — |
| Brightener | 0.05 | 0.05 | 0.05 | — | 0.05 | — | — | — | — |
| Silicone oil | 0.01 | 0.01 | 0.01 | — | — | 0.01 | — | — | — |
| CMC | 1.0 | 2.0 | 2.5 | 1.5 | 0.5 | 4.0 | 1.0 | 2.0 | 0.5 |
| Agglomerate | | | | | | | | | |
| LAS | | | — | — | — | — | 2.0 | 2.0 | — |
| MBAS | | | — | — | — | — | — | — | 1.0 |
| $C_{45}AS$ | | | — | — | — | — | 2.0 | — | — |
| $AE_3$ | | | — | — | — | — | — | 1.0 | 0.5 |
| Carbonate | | | — | — | 4.0 | 1.0 | 1.0 | 1.0 | — |
| Sodium citrate | | | — | — | — | — | — | — | 5.0 |
| CFAA | | | | | — | — | — | — | — |
| Citric acid | | | — | — | — | 4.0 | — | 1.0 | 1.0 |
| QEA | | | — | — | — | 2.0 | 2.0 | 1.0 | — |
| SRP | | | — | — | — | 1.0 | 1.0 | 0.2 | — |

TABLE II-continued

| The following compositions are in accordance with the invention. | A | B | C | D | E | F | G | H | I |
|---|---|---|---|---|---|---|---|---|---|
| Zeolite A | | | — | — | — | 15.0 | 26.0 | 15.0 | 16.0 |
| Sodium silicate | | | — | — | — | — | — | — | — |
| PEG | — | — | — | — | — | — | 4.0 | — | — |
| Builder Agglomerates | | | | | | | | | |
| SKS-6 | 6.0 | — | — | — | 6.0 | 3.0 | — | 7.0 | 10.0 |
| LAS | 4.0 | 5.0 | — | — | 5.0 | 3.0 | — | 10.0 | 12.0 |
| Dry-add particulate components | | | | | | | | | |
| effervescence granule | — | 4.0 | 10.0 | 4.0 | 25 | 8.0 | 12.0 | 2.0 | 4.0 |
| QEA | — | — | — | 0.2 | 0.5 | — | — | — | — |
| NACAOBS | 3.0 | — | — | 4.5 | — | — | — | 2.5 | — |
| NOBS | 1.0 | 3.0 | 3.0 | — | — | — | — | — | 5.0 |
| TAED I | 2.5 | — | — | 1.5 | 2.5 | 6.5 | — | 1.5 | — |
| MBAS | — | — | — | 8.0 | — | — | 8.0 | — | 4.0 |
| LAS (flake) | 10.0 | 10.0 | — | — | — | — | — | 8.0 | — |
| Citric acid II | — | — | — | | | | | | |
| Spray-on | | | | | | | | | |
| Brightener | 0.2 | 0.2 | 0.3 | 0.1 | 0.2 | 0.1 | — | 0.6 | 0.3 |
| Dye | — | — | — | 0.3 | 0.05 | 0.1 | — | — | — |
| AE7 | — | — | — | — | — | 0.5 | — | 0.7 | — |
| Perfume | 1.0 | 0.5 | 1.1 | 0.8 | 0.3 | 0.5 | 0.3 | 0.5 | — |
| Dry-add | | | | | | | | | |
| Citrate | — | — | 20.0 | 4.0 | — | 5.0 | 15.0 | — | 5.0 |
| Percarbonate | 15.0 | 3.0 | 6.0 | 10.0 | — | — | 24.0 | 18.0 | 5.0 |
| Perborate | — | — | — | — | 6.0 | 18.0 | — | — | — |
| Photobleach | 0.02 | 0.02 | 0.02 | 0.1 | 0.05 | — | 0.3 | — | 0.03 |
| Enzymes (cellulase, amylase, protease, lipase) | 1.3 | 0.3 | 0.5 | 0.5 | 0.8 | 2.0 | 0.5 | 0.16 | 0.2 |
| Carbonate | 0.0 | 10.0 | — | — | — | 5.0 | 8.0 | 10.0 | 5.0 |
| Perfume (encapsulated) | — | 0.5 | 0.5 | — | 0.3 | — | 0.2 | — | — |
| Suds suppressor | 1.0 | 0.6 | 0.3 | — | 0.10 | 0.5 | 1.0 | 0.3 | 1.2 |
| Soap | 0.5 | 0.2 | 0.3 | 3.0 | 0.5 | — | — | 0.3 | — |
| Citric acid (I or coarse) | — | — | — | 6.0 | 6.0 | — | — | — | 5.0 |
| Dyed carbonate (blue, green) | 0.5 | 0.5 | 1.0 | 2.0 | — | 0.5 | 0.5 | 0.5 | 1.0 |
| SKS-6 | — | — | — | 4.0 | — | — | — | 6.0 | — |
| Fillers up to 100% | | | | | | | | | |

TABLE III

| The following compositions are in accordance with the invention. | A | B | C | D | E | F | G | H | I |
|---|---|---|---|---|---|---|---|---|---|
| Spray-Dried Granules | | | | | | | | | |
| LAS or LAS (I) | 10.0 | 10.0 | 16.0 | 5.0 | 5.0 | 10.0 | — | — | — |
| TAS | — | 1.0 | — | | | | — | — | — |
| MBAS | — | — | — | 5.0 | 5.0 | | — | — | — |
| $C_{45}AS$ | — | — | 1.0 | | 2.0 | 2.0 | — | — | — |
| $C_{45}AE_3S$ | — | — | — | 1.0 | | | — | — | — |
| QAS | — | — | 1.0 | 1.0 | | | — | — | — |
| DTPA, HEDP and/or EDDS | 0.3 | 0.3 | 0.3 | 0.3 | | | — | — | — |
| MgSO4 | 0.5 | 0.4 | 0.1 | — | | | — | — | — |
| Sodium citrate | 10.0 | 12.0 | 17.0 | 3.0 | 5.0 | | — | — | — |
| Sodium carbonate | 15.0 | 8.0 | 15.0 | | | 10.0 | — | — | — |
| Sodium sulphate | 5.0 | 5.0 | — | — | 5.0 | 3.0 | — | — | — |
| Sodium silicate 1.6 R | — | — | — | — | 2.0 | | — | — | — |
| Zeolite A | — | — | — | 2.0 | — | — | — | — | — |
| SKS-6 | — | — | — | 3.0 | 5.0 | — | — | — | — |
| MA/AA or AA | 1.0 | 2.0 | 10.0 | — | — | 2.0 | — | — | — |
| PEG 4000 | — | 2.0 | — | 1.0 | — | 1.0 | — | — | — |
| QEA | 1.0 | — | — | — | 1.0 | — | — | — | — |

TABLE III-continued

The following compositions are in accordance with the invention.

| | A | B | C | D | E | F | G | H | I |
|---|---|---|---|---|---|---|---|---|---|
| Brightener | 0.05 | 0.05 | 0.05 | — | 0.05 | — | — | — | — |
| Silicone oil | 0.01 | 0.01 | 0.01 | — | — | 0.01 | — | — | — |
| Effervescence granule I, III, IV VII or VIII | 5 | 12 | — | — | — | — | — | — | — |
| Agglomerate | | | | | | | | | |
| LAS | 4.0 | 3.0 | 4.0 | 5.0 | — | — | 2.0 | 2.0 | — |
| STS | 1.0 | 1.0 | — | | — | — | — | — | 1.0 |
| $C_{45}AS$ | — | — | — | — | — | — | 2.0 | — | — |
| $AE_3$ | — | — | — | — | — | — | — | 1.0 | 0.5 |
| Carbonate | — | — | — | — | 4.0 | 1.0 | 1.0 | 1.0 | — |
| Sodium citrate | — | — | — | — | — | — | — | — | 5.0 |
| CMC | 1.0 | 1.5 | 0.8 | 2.0 | 1.0 | 0.5 | 0.3 | 2.8 | 1.5 |
| Citric acid | — | — | — | — | — | 4.0 | — | 1.0 | 1.0 |
| QEA | 1.0 | — | — | — | — | — | 2.0 | 1.0 | 2.0 |
| Adduct 1, 2 or 3 | 2.0 | 0.3 | 1.5 | 2.0 | 0.5 | 1.0 | 1.0 | 0.2 | 0.5 |
| Zeolite A | — | — | — | — | — | 15.0 | 26.0 | 15.0 | 16.0 |
| Sodium silicate | — | — | — | — | — | — | — | — | — |
| PEG | — | — | — | — | — | — | 4.0 | — | — |
| TAED II | | | | | | | 3.0 | | 1.5 |
| Builder Agglomerate | | | | | | | | | |
| SKS-6 | 6.0 | 5.0 | — | — | 6.0 | 3.0 | — | 7.0 | 10.0 |
| LAS | 4.0 | 5.0 | — | — | 5.0 | 3.0 | — | 10.0 | 12.0 |
| Dry-add particulate components | | | | | | | | | |
| Effervescence granule | — | 10.0 | 4.0 | 5 | 15 | 8.0 | 2.0 | 20 | 4.0 |
| NACAOBS | 3.0 | — | — | 1.5 | — | — | — | 5.5 | — |
| NOBS/LOBS/DOBS | — | 3.0 | 3.0 | — | — | — | — | — | 5.0 |
| TAED I | 2.5 | — | — | 1.5 | 2.5 | 6.5 | — | 1.5 | — |
| MBAS | — | — | — | 8.0 | — | — | 8.0 | — | 4.0 |
| LAS (flake) | — | — | — | — | — | — | — | 8.0 | — |
| Spray-on | | | | | | | | | |
| Brightener | 0.2 | 0.2 | 0.3 | 0.1 | 0.2 | 0.1 | — | 0.6 | — |
| Dye | — | — | — | 0.3 | 0.05 | 0.1 | — | — | — |
| AE7 | — | — | — | — | — | 0.5 | — | 0.7 | — |
| Perfume | — | — | — | 0.8 | — | 0.5 | 0.8 | 0.5 | 1.0 |
| Dry-add | | | | | | | | | |
| QEA | — | — | — | 0.2 | 0.5 | — | — | — | — |
| Citrate | 4.0 | — | 3.0 | 4.0 | — | 5.0 | 15.0 | — | 5.0 |
| Percarbonate | 15.0 | 3.0 | 6.0 | 10.0 | — | — | 12.0 | 18.0 | 5.0 |
| Perborate | — | — | — | — | 6.0 | 18.0 | — | — | — |
| Photobleach | 0.02 | 0.02 | 0.02 | 0.1 | 0.05 | — | 0.3 | — | 0.03 |
| Enzymes (cellulase, amylase, protease, lipase) | 1.5 | 0.3 | 0.5 | 0.5 | 0.8 | 2.0 | 0.5 | 0.16 | 0.2 |
| Carbonate II | — | — | — | — | — | 5.0 | 8.0 | 10.0 | 5.0 |
| Perfume (encapsulated) | 0.6 | 0.5 | 0.5 | — | 0.3 | 0.5 | 0.2 | 0.1 | 0.6 |
| Suds suppressor | 1.0 | 0.6 | 0.3 | — | 0.10 | 0.5 | 1.0 | 0.3 | 1.2 |
| Soap | 0.5 | 0.2 | 0.3 | 3.0 | 0.5 | — | — | 0.3 | — |
| Citric acid II | — | — | — | — | — | — | — | 5.0 | 5.0 |
| Dyed carbonate (blue, green) | 0.5 | 0.5 | ? | 2.0 | — | 0.5 | 0.5 | 0.5 | 1.0 |
| SKS-6 | — | — | — | 4.0 | — | — | — | 6.0 | — |
| Fillers up to 100% | | | | | | | | | |

TABLE IV

The following are high density and bleach-containing detergent formulations according to the present invention:

| | A | B | C |
|---|---|---|---|
| Blown Powder | | | |
| Zeolite A | — | — | 15.0 |
| Sodium sulfate | 0.0 | 5.0 | 0.0 |
| LAS | 3.0 | — | 3.0 |

TABLE IV-continued

The following are high density and bleach-containing detergent formulations according to the present invention:

| | A | B | C |
|---|---|---|---|
| C45AS | 3.0 | 2.0 | 4.0 |
| QAS | — | — | 1.5 |
| DTPMP | 0.4 | 0.4 | 0.4 |
| CMC | 0.4 | 0.4 | 0.4 |
| MA/AA | 4.0 | 2.0 | 2.0 |

TABLE IV-continued

| The following are high density and bleach-containing detergent formulations according to the present invention: | A | B | C |
|---|---|---|---|
| effervescence granule I or VIII | 7.0 | | |
| TAED | — | — | 3.0 |
| Agglomerates | | | |
| CMC | — | 1.0 | 1.5 |
| Adduct 1 or 2 | 1.0 | — | — |
| LAS | — | 11.0 | 7.0 |
| TAS or STS | 2.0 | 2.0 | 1.0 |
| Silicate | 3.0 | — | 4.0 |
| Zeolite A | 8.0 | 8.0 | 8.0 |
| Carbonate | .8.0 | 8.0 | 4.0 |
| Agglomerate | | | |
| Adduct 1 or 2 | 1.0 | — | — |
| CMC | 3.0 | — | — |
| Spray On | | | |
| Perfume | 0.3 | 0.3 | 0.3 |
| C25E3 | 2.0 | — | 2.0 |
| brightener | 0.1 | 0.4 | |
| photobleach | 0.03 | 0.05 | — |
| Dry additives | | | |
| QEA | 1.0 | 0.5 | 0.5 |
| Citric acid I | 5.0 | — | 2.0 |
| Bicarbonate I | — | 3.0 | — |
| Carbonate II | 8.0 | 15.0 | 10.0 |
| NAC OBS | 6.0 | — | 5.0 |
| Manganese catalyst | — | — | 0.3 |
| TAED I | | 3.0 | — |
| NOBS | — | 2.0 | — |
| Percarbonate | 14.0 | 7.0 | 10.0 |
| Polyethylene oxide of MW 5,000,000 | — | — | 0.2 |
| Bentonite clay | — | — | 10.0 |
| effervescence granule | — | 5.5 | 7.5 |
| Protease | 1.0 | 1.0 | 1.0 |
| Lipase | 0.4 | 0.4 | 0.4 |
| Amylase | 0.6 | 0.6 | 0.6 |
| Cellulase | 0.6 | 0.6 | 0.6 |
| Silicone antifoam | 5.0 | 5.0 | 5.0 |
| Balance (Moisture and Miscellaneous) | 100.0 | 100.0 | 100.0 |
| Density (g/litre) | 850 | 850 | 850 |

TABLE V

| The following liquid composition is in accord with the invention | | | |
|---|---|---|---|
| Component | Wt. % | Wt. % | Wt. % |
| $C_{12-15}$ alkyl ether (2.5) sulfate | 38 | 38 | 38 |
| $C_{12}$ glucose amide | 6.86 | 6.86 | 6.86 |
| Citric Acid | 4.75 | 4.75 | 4.75 |
| $C_{12-14}$ Fatty Acid | 2.00 | 2.00 | 2.00 |
| Enzymes | 1.02 | 1.02 | 1.02 |
| MEA | 1.0 | 1.0 | 1.0 |
| Propanediol | 0.36 | 0.36 | 0.36 |
| Borax | 6.58 | 6.58 | 6.58 |
| Dispersant | 1.48 | 1.48 | 1.48 |
| Na Toluene Sulfonate | 6.25 | 6.25 | 6.25 |
| Adduct 1, 2, 4 or 5 | 1.0 | 0.5 | 2.0 |

TABLE V-continued

| The following liquid composition is in accord with the invention | | | |
|---|---|---|---|
| Component | Wt. % | Wt. % | Wt. % |
| CMC | 1.0 | 2.5 | 0.5 |
| Dye, Perfume, Brighteners, | Balance | Balance | Balance |
| Preservatives, Suds Suppressor, Other Minors, Water | 100% | 100% | 100% |

TABLE V

| The following liquid detergent formulations are prepared according to the present invention | | | | | |
|---|---|---|---|---|---|
| | A | B | C | D | E |
| LAS | 11.5 | 9.0 | — | 4.0 | — |
| C25E2.5S | — | 3.0 | 18.0 | — | 16.0 |
| C45E2.25S | 11.5 | 3.0 | — | 16.0 | — |
| C23E9 | — | 3.0 | 2.0 | 2.0 | 1.0 |
| C23E7 | 3.2 | — | — | — | — |
| CFAA | — | — | 5.0 | — | 3.0 |
| TPKFA | 2.0 | — | 2.0 | 0.5 | 2.0 |
| Citric (50%) | 6.5 | 1.0 | 2.5 | 4.0 | 2.5 |
| Ca formate | 0.1 | 0.06 | 0.1 | — | — |
| Na formate | 0.5 | 0.06 | 0.1 | 0.05 | 0.05 |
| STS | 4.0 | 1.0 | 3.0 | 1.2 | — |
| Borate | 0.6 | — | 3.0 | 2.0 | 3.0 |
| Na hydroxide | 6.0 | 2.0 | 3.5 | 4.0 | 3.0 |
| Ethanol | 2.0 | 1.0 | 4.0 | 4.0 | 3.0 |
| 1.2 Propanediol | 3.0 | 2.0 | 8.0 | 8.0 | 5.0 |
| Monoethanolamine | 3.0 | 1.5 | 1.0 | 2.5 | 1.0 |
| CMC | 2.0 | 1.0 | 1.0 | 3.0 | 0.4 |
| Adduct 1, 2 or 6 | 0.3 | 1.0 | 2.0 | 0.8 | 1.0 |
| Protease | 0.03 | 0.01 | 0.03 | 0.02 | 0.02 |
| Lipase | — | — | 0.002 | — | — |
| Amylase | — | — | — | 0.002 | — |
| Cellulase | — | — | 0.0002 | 0.0005 | 0.0001 |
| SRP | 0.2 | — | 0.1 | — | — |
| DTPA | — | — | 0.3 | — | — |
| PVNO | — | — | 0.3 | — | 0.2 |
| Brightener I | 0.2 | 0.07 | 0.1 | — | — |
| Silicone antifoam | 0.04 | 0.02 | 0.1 | 0.1 | 0.1 |
| | | | | | Miscellaneous and water |

TABLE VII

The following liquid detergent formulations are according to the present invention

| | A | B | C | D | E | F | G | H |
|---|---|---|---|---|---|---|---|---|
| LAS | 10.0 | 13.0 | 9.0 | — | 25.0 | — | — | — |
| C25AS | 4.0 | 1.0 | 2.0 | 10.0 | — | 13.0 | 18.0 | 15.0 |
| C25E3S | 1.0 | — | — | 3.0 | — | 2.0 | 2.0 | 4.0 |
| C25E7 | 6.0 | 8.0 | 13.0 | 2.5 | — | — | 4.0 | 4.0 |
| TFAA | — | — | — | 4.5 | — | 6.0 | 8.0 | 8.0 |
| APA | — | 1.4 | — | — | 3.0 | 1.0 | 2.0 | — |
| TPKFA | 2.0 | — | 13.0 | 7.0 | — | 15.0 | 11.0 | 11.0 |
| Citric | 2.0 | 3.0 | 1.0 | 1.5 | 1.0 | 1.0 | 1.0 | 1.0 |
| Dodecenyl/ tetradecenyl succinic acid | 12.0 | 10.0 | — | — | 15.0 | — | — | — |
| Rapeseed fatty acid | 4.0 | 2.0 | 1.0 | — | 1.0 | — | 3.5 | — |
| Ethanol | 4.0 | 4.0 | 7.0 | 2.0 | 7.0 | 2.0 | 3.0 | 2.0 |
| 1,2 Propanediol | 4.0 | 4.0 | 2.0 | 7.0 | 6.0 | 8.0 | 10.0 | 13.0 |
| Monoethanolamine | — | — | — | 5.0 | — | — | 9.0 | 9.0 |
| Triethanolamine | — | — | 8.0 | — | — | — | 0.4 | 0.3 |
| CMC | 0.2 | 2.0 | 0.5 | 0.7 | 2.0 | 1.2 | 1.0 | 4.0 |
| Adduct 1 or 2 | 0.3 | 0.4 | 0.5 | 1.0 | 1.0 | 2.0 | 0.5 | 1.0 |
| DETPMP | 1.0 | 1.0 | 0.5 | 1.0 | | | | |
| Carbohydrase | | | | | 0.08 | 0.02 | 0.01 | 0.02 |
| Protease | 0.02 | 0.02 | 0.01 | .008 | — | — | .003 | .003 |
| Lipase | — | .002 | — | .002 | .004 | 0.01 | 0.01 | 0.01 |
| Amylase | .004 | .004 | 0.01 | .008 | — | — | .004 | .003 |
| Cellulase | — | — | — | .002 | — | — | 0.2 | 0.1 |
| SRP 2 | 0.3 | — | 0.3 | 0.1 | 1.0 | 1.5 | 2.5 | 2.5 |
| Boric acid | 0.1 | 0.2 | 1.0 | 2.0 | 4.0 | 4.0 | — | — |
| Ca chloride | — | 0.02 | — | 0.01 | 0.1 | 0.2 | 0.3 | — |
| Brightener 1 | — | 0.4 | — | — | 0.4 | — | — | — |
| Suds suppressor | 0.1 | 0.3 | — | 0.1 | 0.8 | 0.7 | — | — |
| Opacifier | 0.5 | 0.4 | — | 0.3 | 8.0 | 7.5 | 8.0 | 8.2 |
| NaOH up to pH | 8.0 | 8.0 | 7.6 | 7.7 | | | | Miscell-aneous and water |

What is claimed is:

1. A detergent composition or component comprising:

a) from 0.01% to 90% by weight, of a salt of an anionic cellulose material comprising an anionic substituent group R—X—Z wherein R is a saturated, unsaturated or aromatic hydrocarbon spacer group, X is oxygen, nitrogen or sulphur, Z is carboxylate, sulphonate, sulphate or phosphonate group; and b) from 0.01% to 90% by weight, of a cyclic amine based polymer, oligomer, or copolymer of the general formula:

$$T\text{-}[W\text{—}R_2]_x\text{-}W\text{—}T\ A_b,$$

wherein:

—$(CH_2)_hCOOM$, —$(CH_2)_hSO_3M$, $CH_2CH(OH)SO_3M$, —$(CH_2)_hOSO_3M$,

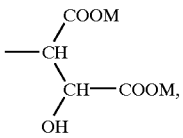

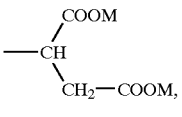

-continued

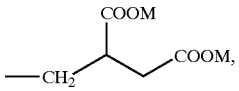

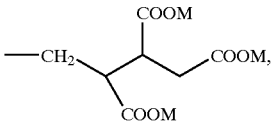

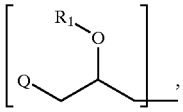

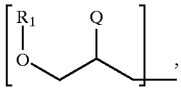

and —$R_2Q$;

wherein W comprises at least one cyclic constituent selected from the group consisting of:

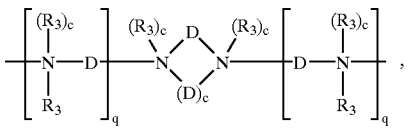

-continued

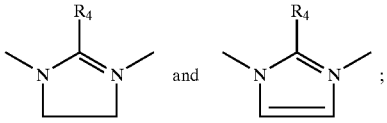

in addition to the at least one cyclic constituent, W may also comprise an aliphatic or substituted aliphatic moiety of the general structure;

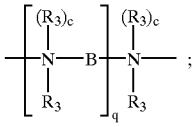

each B is independently $C_1$–$C_{12}$ alkylene, $C_1$–$C_{12}$ substituted alkylene, $C_3$–$C_{12}$ alkenylene, $C_8$–$C_{12}$ dialkylarylene, $C_8$–$C_{12}$ dialkylarylenediyl, and —$(R_5O)_nR_5$—;

each D is independently $C_2$–$C_6$ alkylene;

each Q is independently selected from the group consisting of hydroxy, $C_1$–$C_{18}$ alkoxy, $C_2$–$C_{18}$ hydroxyalkoxy, amino, $C_1$–$C_{18}$ alkylamino, dialkylamino, trialkylamino groups, heterocyclic monoamino groups and diamino groups;

each $R_1$ is independently selected from the group consisting of H, $C_1$–$C_8$ alkyl and $C_1$–$C_8$ hydroxyalkyl;

each $R_2$ is independently selected from the group consisting of $C_1$–$C_{12}$ alkylene, $C_1$–$C_{12}$ alkenylene, —$CH_2$—$CH(OR_1)$—$CH_2$, $C_8$–$C_{12}$ alkarylene, $C_4$–$C_{12}$ dihydroxyalkylene, poly($C_2$–$C_4$ alkyleneoxy)alkylene, $H_2CH(OH)CH_2OR_2OCH_2CH(OH)CH_2$—, and $C_3$–$C_{12}$ hydrocarbyl moieties;

provided that when $R_2$ is a $C_3$–$C_{12}$ hydrocarbyl moiety the hydrocarbyl moiety can comprise from 2 to 4 branching moieties of the general structure:

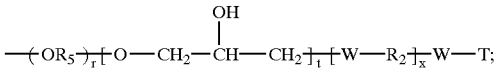

each $R_3$ is independently selected from the group consisting of H, O, $R_2$, $C_1$–$C_{20}$ hydroxyalkyl, $C_1$–$C_{20}$ alkyl, substituted alkyl, $C_6$–$C_{11}$ aryl, substituted aryl, $C_7$–$C_{11}$ alkylaryl, $C_1$–$C_{20}$ aminoalkyl, —$(CH_2)_hCOOM$, —$(CH_2)_hSO_3M$, $CH_2CH(OH)SO_3M$, —$(CH_2)_hOSO_3M$,

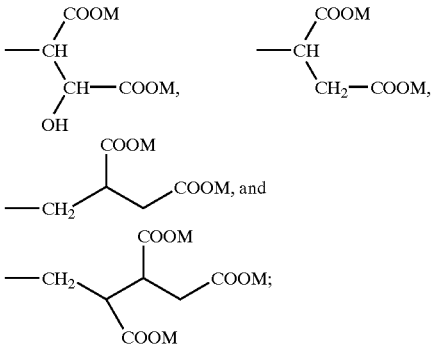

each $R_4$ is independently selected from the group consisting of H, $C_1$–$C_{22}$ alkyl, $C_1$–$C_{22}$ hydroxyalkyl, aryl and $C_7$–$C_{22}$ alkylaryl;

each $R_5$ is independently selected from the group consisting of $C_2$–$C_8$ alkylene, $C_2$–$C_8$ alkyl substituted alkylene; and A is a compatible monovalent or di or polyvalent anion;

M is a compatible cation;

b=number necessary to balance the charge;

each x is independently from 3 to 1000;

each c is independently 0 or 1;

each h is independently from 1 to 8;

each q is independently from 0 to 6;

each n is independently from 1 to 20;

each r is independently from 0 to 20; and each t is independently from 0 to 1.

2. A detergent composition or component according to claim 1 wherein the cellulose material wherein R is an $C_1$–$C_4$ alkylene group, X is oxygen.

3. A detergent composition or component according to claim 2 wherein the anionic cellulose material comprises carboxymethyl cellulose in the form of a sodium therefore.

4. A detergent composition to claim 1 wherein the cyclic amine based polymers are adducts comprising group selected from the group consisting or piperazine, piperadine, epichlorohydrin, epichlorohydrin benzyl quat, epichlorohydrin methyl quat, morpholine, imidazole-epichlorohydrin copolymers and mixtures therefor.

5. A detergent composition or component according to claim 1, wherein each $R_1$ is H and at least one W is selected from the group consisting of:

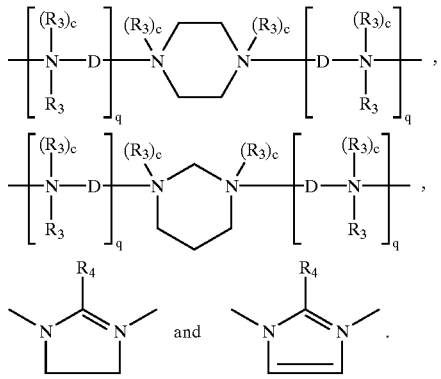

6. A detergent composition or component according to claim 1, wherein each $R_1$ is H and at least one W is selected from the group consisting of:

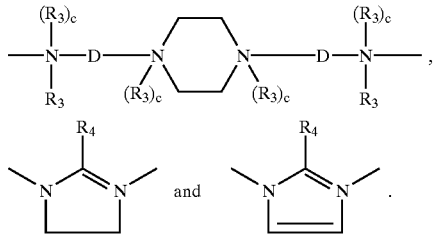

7. A detergent composition or component according to claim 1, wherein each $R_1$ is H and at least one W is selected from the group consisting of:

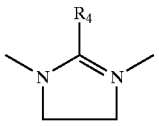

and

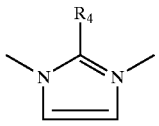

.

8. A detergent component of composition according to claim 1 wherein the cyclic amine based polymer and the anionic cellulose material are in an intimate mixture with one another.

9. A component or composition according to claim 8 whereby the intimate mixture is present in or in the form of an agglomerated granule, compacted granule or spray dried granule.

10. A laundry composition according to claim 1 wherein the composition one or more fabric softening components and/or dye transfer inhibiting components.

* * * * *